US008976504B2

(12) United States Patent
Katsuraya et al.

(10) Patent No.: US 8,976,504 B2
(45) Date of Patent: Mar. 10, 2015

(54) IGNITION SYSTEM AND SPARK PLUG

(75) Inventors: Kohei Katsuraya, Aichi (JP); Katsutoshi Nakayama, Aichi (JP)

(73) Assignee: NGK Spark Plug Co., Ltd., Nagoya, Aichi (JP)

( * ) Notice: Subject to any disclaimer, the term of this patent is extended or adjusted under 35 U.S.C. 154(b) by 137 days.

(21) Appl. No.: 13/817,544

(22) PCT Filed: Jul. 11, 2011

(86) PCT No.: PCT/JP2011/065771

§ 371 (c)(1), (2), (4) Date: Feb. 19, 2013

(87) PCT Pub. No.: WO2012/032846

PCT Pub. Date: Mar. 15, 2012

(65) Prior Publication Data

US 2013/0148254 A1 Jun. 13, 2013

(30) Foreign Application Priority Data

Sep. 7, 2010 (JP) ..... 2010-199740
Sep. 8, 2010 (JP) ..... 2010-200560

(51) Int. Cl.

| | |
|---|---|
| ***F23Q 3/00*** | (2006.01) |
| ***F02P 3/01*** | (2006.01) |
| ***H01T 13/40*** | (2006.01) |
| ***H01T 13/50*** | (2006.01) |
| *F02P 9/00* | (2006.01) |

(52) U.S. Cl.

CPC . *F02P 3/01* (2013.01); *H01T 13/40* (2013.01); *H01T 13/50* (2013.01); *F02P 9/007* (2013.01)

USPC ..... 361/253

(58) Field of Classification Search

CPC ..... F02P 3/01; F02P 9/0007; F02P 23/045; H01T 13/50; H01T 13/40

USPC ..... 361/253

See application file for complete search history.

(56) References Cited

U.S. PATENT DOCUMENTS

| | | | | |
|---|---|---|---|---|
| 3,934,566 | A | 1/1976 | Ward | 123/119 E |
| 4,138,980 | A | 2/1979 | Ward | 123/119 E |
| 5,577,471 | A * | 11/1996 | Ward | 123/169 EL |
| 2002/0038992 | A1 | 4/2002 | Morita et al. | 313/141 |
| 2004/0061421 | A1 | 4/2004 | Morita et al. | 313/142 |
| 2004/0129241 | A1 | 7/2004 | Freen | 123/143 B |
| 2010/0187968 | A1 | 7/2010 | Ikeda et al. | 313/134 |

(Continued)

FOREIGN PATENT DOCUMENTS

| | | | |
|---|---|---|---|
| JP | 51-77719 | 7/1976 | F02H 27/00 |
| JP | 2005-243435 | 9/2005 | |

(Continued)

OTHER PUBLICATIONS

Int'l Search Report from corresponding PCT/JP2011/065771 (Form PCT/ISA/210); 2 pages.

*Primary Examiner* — Scott Bauer
(74) *Attorney, Agent, or Firm* — Kusner & Jaffe

(57) ABSTRACT

An ignition system having a spark plug, a discharge power supply, and an AC power supply. Voltage from the discharge power supply and AC power from the AC power supply are supplied to a spark discharge gap through an electrode of the spark plug. The AC power from the AC power supply is applied to a spark generated by the voltage from the discharge power supply in the spark discharge gap.

14 Claims, 17 Drawing Sheets

(56) References Cited

U.S. PATENT DOCUMENTS

| | | | | |
|---|---|---|---|---|
| 2010/0196208 | A1 | 8/2010 | Makita et al. | 422/83 |
| 2010/0206276 | A1 | 8/2010 | Deloraine et al. | 123/608 |

FOREIGN PATENT DOCUMENTS

| | | |
|---|---|---|
| JP | 2006-120649 | 5/2006 |
| JP | 2009-8100 | 1/2009 |
| JP | 2009/36198 | 2/2009 |
| JP | 2009-37750 | 2/2009 |
| JP | 2009-38026 | 2/2009 |
| JP | 2010/101208 | 5/2010 |
| JP | 2010/529363 | 8/2010 |
| WO | WO 2009008518 A1 * | 1/2009 |

* cited by examiner

IGNITION SYSTEM AND SPARK PLUG

FIELD OF THE INVENTION

The present invention relates to an ignition system and a spark plug, which are used for an internal combustion engine or the like.

BACKGROUND OF THE INVENTION

A spark plug used for a combustion apparatus such as an internal combustion engine includes, for example, a center electrode extending in an axis direction thereof, an insulator provided on a periphery of the center electrode, a tubular metallic shell assembled to the outside of the insulator, and a ground electrode having a proximal end portion joined to a tip end portion of the metal shell. When high voltage is applied to the center electrode, a spark is generated in a gap formed between the center electrode and the ground electrode. As a result, fuel gas is ignited.

In recent years, there has been known a technology for generating a spark by applying AC power (high frequency power) to the gap instead of high voltage to promote an improvement in ignitability (see, for example, JP-A-2009-8100).

However, a spark is generated only by high frequency power in the above technology. Accordingly, depending on the condition inside a combustion chamber, the required voltage may not be produced by high frequency power alone. Therefore, even if high frequency power is applied, a situation where a spark is not generated (what is called a misfire) is likely to occur.

Hence, there has been proposed a technology for promoting an improvement in ignitability by providing an antenna for radiating an electromagnetic wave in addition to the center electrode and the ground electrode for generating a spark, and growing a spark (plasma) generated between the electrodes by an electromagnetic wave radiated from the antenna (see, for example, JP-A-2009-38026).

In the technology described in JP-A-2009-38026, however, since an electromagnetic wave is transmitted to a spark (plasma) through a space in the technology described in JP-A-2009-38026, an efficient application of energy to the spark cannot be performed and the effect of an improvement in ignitability is therefore small. Moreover, efficient radiation of an electromagnetic wave requires minute adjustments of the size of the antenna, and the like in consideration of factors, such as the wavelength, frequency, and the like of the electromagnetic waves, which may lead to an increase in manufacturing costs.

The present invention has been made in consideration of the above circumstances, and provides an ignition system and a spark plug, which can apply energy to a spark efficiently without increasing the manufacturing cost, and dramatically improve ignitability.

SUMMARY OF THE INVENTION

Hereinafter, configurations of the present invention will be respectively described in itemized form.

If required, actions and effects peculiar to the configurations will be described additionally.

Configuration 1: In accordance with the present invention, there is provided an ignition system comprising:

a spark plug;

a discharge power supply for applying voltage to the spark plug to generate a spark discharge; and an AC power supply for supplying AC power to a spark generated by the spark discharge, wherein the spark plug includes an insulator having an axial hole extending in an axis direction thereof, an electrode disposed in the axial hole and having a tip end located frontward of a tip end of the insulator in the axis direction, a metal shell arranged on a periphery of the insulator, and a ground electrode fixed to a tip end portion of the metal shell and forming a gap between the tip end portion of the electrode and the ground electrode, voltage from the discharge power supply and AC power from the AC power supply are supplied to the gap through the electrode, and the AC power from the AC power supply is applied to a spark generated in the gap by the voltage from the discharge power supply.

According to the above configuration 1, it is configured such that both the voltage from the discharge power supply and the AC power from the AC power supply pass through the electrode (in other words, pass through the same line) to be supplied to the gap. Therefore, the AC power is applied directly to a spark, not through a space or the like, and energy can be applied to the spark efficiently. As a result, the plasma to be generated by applying AC power to the spark can be made larger, and ignitability can be dramatically improved.

Moreover, in the above configuration 1, adjustments for radiating an electromagnetic wave as in the above-mentioned conventional technology are unnecessary. Further, the electrode functions as a common transmission path, so that the number of parts can be reduced compared with the case where an antenna and the like are provided. As a result, manufacturing cost reduction can be promoted.

Configuration 2: In accordance with a second aspect of the present invention, there is provided an ignition system as described in the above configuration 1, wherein, when the wavelength of the AC power set to $\lambda$(m), the protruding length of the tip end of the electrode from the tip end of the metal shell along the axis is set to $\lambda/8$ (m) or less.

According to the above configuration 2, when the wavelength of the AC power is set to $\lambda$(m), the protruding length of the tip end of the electrode from the tip end of the metal shell is made as sufficiently small as $\lambda/8$ (m) or less. Therefore, the radiation of an electromagnetic wave from the electrode can be more reliably prevented, and energy can be applied to a spark more efficiently. That is, the above conventional technology is for promoting the enhancement of a spark (plasma) by radiating an electromagnetic wave. However, according to the configuration 2, contrary to the conventional technology, the radiation of an electromagnetic wave is prevented to enable the generation of larger plasma, and ignitability can be still further improved.

In addition, according to the above configuration 2, the overheating of the tip end portion of the electrode can be suppressed, and therefore matters, such as electrode erosion and ignition using the electrode as a heat source, can be prevented more reliably.

Configuration 3: In accordance with a third aspect of the present invention, there is provided an ignition system as described in the above configurations 1 or 2, wherein the average value of the AC power to be applied to a spark at one spark discharge is set to 50 W or more and 500 W or less.

The "average value" is a value obtained by dividing the amount of applied power by a period of time (seconds) from the start to end of applying AC power at one spark discharge.

According to the above configuration 3, the average value of AC power to be applied to a spark at one spark discharge (hereinafter referred to as the "average power") is set to 50 W or more. Consequently, plasma can be generated more reliably, and therefore the actions and effects of the above configurations can be achieved more reliably.

On the other hand, if the average power is increased, a further improvement in ignitability can be expected, but the tip end portion of the electrode is suddenly worn with use. Accordingly, a spark discharge voltage may increase rapidly.

In this respect, according to the above configuration 3, the average power is set to 500 W or less. Accordingly, the sudden wear of the electrode can be suppressed effectively, and an increasing speed of a spark discharge voltage can be suppressed. As a result, a period during which plasma can be generated can be made longer, and excellent ignitability can be maintained for a longer period of time.

Configuration 4: In accordance with a fourth aspect of the present invention, there is provided an ignition system as described in any of the above configurations 1 to 3, wherein the size of the gap is set to 1.3 mm or less.

According to the above configuration 4, the size of the gap is set to 1.3 mm or less. Accordingly, the discharge resistance of a spark generated in the gap can be made sufficiently small. Consequently, the flow of AC power to a spark can be facilitated, and ignitability can be still further improved.

If the size of the gap is made excessively small, a phenomenon where a fuel and carbon link the tip end portion of the electrode and the ground electrode (what is called a bridge) is likely to occur. In the ignition systems of the above configurations, the electrode and the ground electrode are subjected to higher temperature during their use due to the influence of plasma, than those in an ignition system that generates only a spark. Hence, the electrode and the ground electrode deform more easily, and the size of the gap is likely to become small with use. Therefore, in such an ignition system, it is preferable that the size of the gap be made sufficiently large (e.g., 0.5 mm or more) to prevent the occurrence of a bridge more reliably.

Configuration 5: In accordance with a fifth aspect of the present invention, there is provided an ignition system as described in any of the above configurations 1 to 4, wherein the insulator does not exist in an area with a radius of 1 mm from the center of the gap.

"Center of the gap" indicates the midpoint of the line segment connecting the center of a surface of the electrode, the surface facing the ground electrode across the gap, and the center of a surface of the ground electrode, the surface facing the electrode across the gap (the same shall apply below).

If a spark discharge is generated in the vicinity of the insulator, the generated plasma is likely to come into contact with the insulator, and the surface of the insulator is likely to be subjected to higher temperature. If the surface of the insulator is subjected to high temperature, a foreign object such as carbon is likely to accumulate on the surface of the insulator; accordingly, leakage of current that is conducted over the surface of the insulator, and the like may occur.

In this respect, according to the above configuration 5, it is configured such that the insulator does not exist in an area with a radius of 1 mm from the center of the gap, and a spark discharge is generated at a position away from the insulator. Therefore, the generated plasma is unlikely to come into contact with the insulator, which makes it possible to more reliably prevent a foreign object from accumulating on the surface of the insulator.

Configuration 6: In accordance with a sixth aspect of the present invention, there is provided an ignition system as described in any of the above configurations 1 to 5, wherein the oscillation frequency of the AC power is set to 5 MHz or more and 100 MHz or less.

When both the voltage from the discharge power supply and the AC power from the AC power supply are mixed to be supplied to the electrode, it is conceivable that a capacitor is used to prevent a current to be output from the discharge power supply from flowing to the AC power supply side while permitting the passage of the AC power. The smaller the oscillation frequency of the AC power, the more necessary it is to use a capacitor with larger electrostatic capacity in order to pass the AC power. However, a relatively high frequency component can be included in the current to be output from the discharge power supply. If the electrostatic capacity of the capacitor is made excessively large in accordance with a reduction in the oscillation frequency of the AC power, not only the AC power but also the high frequency component may pass through the capacitor. If the current to be output from the discharge power supply flows to the AC power supply side, situations such as a breakage of the AC power supply and a reduction in energy to be supplied to the gap may occur.

In this respect, according to the above configuration 6, the oscillation frequency of the AC power is made as sufficiently large as 5 MHz or more. Therefore, there will be no need to excessively increase the electrostatic capacity of the capacitor to permit the passage of the AC power, which leads to the prevention of flow of the current, to be output from the discharge power supply, to the AC power supply side. As a result, the breakage of the AC power supply can be more reliably prevented as well as energy can be applied to a spark more efficiently.

On the other hand, the AC power flows over the outer surface of a conductor by what is called a skin effect. However, if the oscillation frequency of the AC power is increased excessively, electrical resistance in the transmission path of the AC power is increased, and energy to be applied to a spark may be reduced.

In this respect, according to the above configuration 6, the oscillation frequency of the AC power is set to 100 MHz or less, and the suppression of an increase in electrical resistance in the transmission path of the AC power is promoted. As a result, energy can be applied to a spark more efficiently, and ignitability can be further improved.

Configuration 7: In accordance with a seventh aspect of the present invention, there is provided an ignition system as described in any of the above configurations 1 to 6, wherein the electrostatic capacity of a portion of the spark plug, the portion being located frontward of the tip end of the metal shell in the axis direction, is set equal to or less than one hundredth of the electrostatic capacity of the whole spark plug.

If the electrostatic capacity of the portion of the spark plug, the portion being located frontward of the metal shell, makes up a large proportion of the electrostatic capacity of the whole spark plug, a change in impedance on the spark plug side relative to the AC power supply becomes large between at the time of a spark discharge and at the time of the generation of plasma. As a result, electric power is likely to be reflected, and a reduction in energy to be applied to a spark may occur.

In this respect, according to the above configuration 7, the electrostatic capacity of the portion of the spark plug, the portion being frontward of the tip end of the metal shell, is made as very small as equal to or less than one hundredth of the electrostatic capacity of the whole spark plug. Consequently, a change in impedance can be made extremely small between at the time of a spark discharge and at the time of the generation of plasma, and the reflection of electric power can be suppressed to a minimum. As a result, energy can be applied to a spark more efficiently, and a further improvement in ignitability can be promoted.

Configuration 8: In accordance with an eighth aspect of the present invention, there is provided an ignition system as described in any of the above configurations 1 to 7, wherein the total volume of portions of the electrode, the ground electrode and the insulator, the portions being located in an area with a radius of 2.5 mm from the center of the gap, is set to 20 $mm^3$ or less.

In the field of spark plugs of the type that ignites by a spark, there is known a method in which a protrusion is provided to a portion of the ground electrode, the portion facing the tip end portion of the electrode, to promote an improvement in ignitability (e.g., JP-A-2009-37750). According to the method, matters where the electrode and the ground electrode inhibit the growth of an initial flame generated by a spark can be suppressed.

Also in the ignition systems according to the above configuration 1 and the like (namely, those generating AC (high frequency) plasma in the gap by applying AC (high frequency) power to the gap to promote a further improvement in ignitability), it is conceivable that an improvement in ignitability is promoted by adopting the method described in the above JP-A-2009-37750, similarly to spark plugs of the type that ignites by a spark.

Hence, the inventors of the present application manufactured a sample of a spark plug provided with a protrusion 27P at a portion of a ground electrode 27, the portion facing a tip end portion of an electrode 8 (sample A), as illustrated in FIG. 23(*a*), and a sample of a spark plug in which a portion of the ground electrode 27, the portion facing a center electrode 5, was formed in a flat shape (sample B), as illustrated in FIG. 23(*b*). The samples were measured for the misfire rate of when high voltage was applied to generate a spark and the misfire rate of when AC power (high frequency power) was applied to generate plasma, and were checked on whether or not ignitability improved. Table 1 shows the samples' misfire rate of when high voltage was applied and misfire rate of when AC power was applied. The misfire rate represents the rate of the occurrence of a misfire, and indicates that the smaller the rate, the better the ignitability. Moreover, assume that high voltage was applied by a power supply device with output energy of 30 mJ, AC power was applied by a high frequency power supply with an oscillation frequency of 13 MHz and output power (an average value per second of the amount of power to be applied) of 300 W, and the application time of power was set to 1 ms. Further, the application of high voltage and the application of AC power were performed 1000 times, respectively. In addition, the outside diameter of the tip end portion of the electrode was set to 1.5 mm and the size of the gap to 0.8 mm for both of the samples, and the outside diameter of the protrusion 27P was set to 1.5 mm for the sample A.

TABLE 1

| | Misfire rate | |
|---|---|---|
| | Application of high voltage | Application of AC power |
| Sample A | 0.0% | 0.3% |
| Sample B | 0.5% | 0.0% |

As shown in Table 1, the results show that if high voltage was applied to generate a spark, the sample A was superior in ignitability to the sample B; however, if AC power was applied to generate plasma, the sample A was inferior in ignitability to the sample B. In other words, it became clear that even if a method that can realize an improvement in ignitability in the spark plug of the type that ignites by a spark is used, ignitability cannot necessarily be improved in the spark plug of the type that ignites by plasma.

It is conceivable that such results were produced for the following reason. That is, the point to improve ignitability in spark plugs of the type that ignites by a spark is how not to inhibit the growth of an initial flame generated by a spark. Therefore, it is effective to reduce the volume of the ground electrode and the center electrode especially in the vicinity of a spark generation position (gap), as in the sample A, to grow the initial flame further. On the other hand, in spark plugs of the type that ignites by plasma, much larger plasma than the initial flame can be generated immediately after the application of power, and how to generate large plasma immediately after the application of power is important to promote an improvement in ignitability. To promote an improvement in ignitability in such a spark plug, therefore, it is necessary to appropriately set the volumes of the ground electrode and the center electrode in a gap-centered wide area where plasma can be generated, and it is thus insufficient to only reduce the volume of the ground electrode and the like in the vicinity of the gap.

Considering this point, according to the above configuration 8, the total volume of the electrode, the ground electrode and the insulator is set to 20 $mm^3$ or less in a very wide area, i.e., an area with a radius of 2.5 mm from the center of the gap. That is, in an area where plasma can be generate, the total volume of the electrode, the ground electrode, and the like is made sufficiently small. Larger plasma can be therefore generated immediately after the application of the AC power while being prevented as much as possible from the inhibition by the electrode, the ground electrode, and the like. As a result, ignitability can be dramatically improved.

Configuration 9: In accordance with a ninth aspect of the present invention, there is provided an ignition system as described in the above configuration 8, wherein on a projection plane of when projecting the ground electrode and the center of the gap on a surface orthogonal to a line segment linking the electrode and the ground electrode and forming the shortest distance of the gap with respect to a direction in which the line segment extends, the area of a projection region of the ground electrode, which is located in an area with a radius of 2 mm from a projection point at the center of the gap, is set to 7.6 $mm^2$ or less.

According to the above configuration 9, the inhibition of the growth of plasma by the ground electrode can be more reliably suppressed, and much larger plasma can be generated. As a result, ignitability can be dramatically improved.

Configuration 10: In accordance with a tenth aspect of the present invention, there is provided an ignition system as described in the above configurations 8 or 9, wherein the ground electrode includes a gap corresponding portion corresponding to the gap in the axis direction, and the minimum width of the gap corresponding portion is set to 3.0 mm or less.

"Gap corresponding portion" indicates a portion of the ground electrode, the portion being located at the same height as the gap along the axis direction.

An airflow such as a swirl is generated in a combustion chamber such as an internal combustion engine, and plasma spreads in a manner of flowing out of the gap by the airflow to enable the growth of the plasma. However, an airflow may be generated from the back side of the ground electrode toward the gap side, depending on the attached state of a spark plug to a combustion apparatus such as an internal combustion engine. In this case, the airflow is unlikely to enter the gap due to the ground electrode, and it may become difficult to grow plasma largely.

In this respect, according to the above configuration 10, the minimum width of the gap corresponding portion of the ground electrode, the gap corresponding portion corresponding to the gap, is set to 3.0 mm or less, and the airflow can be made easy to flow into the gap. As a result, plasma can be grown more largely, carried by the airflow, and ignitability can be further improved.

Furthermore, the smaller the minimum width of the gap corresponding portion is made, the more the improvement in ignitability can be expected. However, if the ground electrode is made excessively thin, a trouble occurs in thermal conduction from the ground electrode to the metal shell, and the wear resistance of the ground electrode may be reduced. Therefore, from the viewpoint of preventing a reduction in wear resistance, the minimum width of the gap corresponding portion is preferably set to 1.0 mm or more.

Configuration 11: In accordance with an eleventh aspect of the present invention, there is provided an ignition system as described in any of the above configurations 8 to 10, wherein when viewed from the tip end side in the axis direction, at least part of a tip end surface of the electrode is configured to be visually identifiable.

According to the above configuration 11, plasma is more likely to spread toward the center side of the combustion chamber without being inhibited by the ground electrode. As a result, ignitability can be still further improved.

Configuration 12: In accordance with a twelfth aspect of the present invention, there is provided an ignition system as described in any of the above configurations 8 to 11, wherein at least the tip end portion of the electrode forms a circular column, and the outside diameter of the tip end portion of the electrode is set to 3.0 mm or less.

According to the above configuration 12, the inhibition of the growth of plasma due to the tip end portion of the electrode can be effectively suppressed, and a further improvement in ignitability can be thus promoted.

If the outside diameter of the tip end portion of the electrode is made excessively small, the gap is quickly widened with use, and a situation of a sudden increase in spark discharge voltage, and the shortening of a period during which plasma can be generated, may occur. Therefore, from the viewpoint of maintaining excellent ignitability for a long period of time, it is preferable that the outside diameter of the tip end portion of the electrode be 0.5 mm or more.

Configuration 13: In accordance with a thirteenth aspect of the present invention, there is provided an ignition system as described in any of the above configurations 8 to 12, wherein the protruding length of the ground electrode from the tip end of the metal shell along the axis is set to 10 mm or less.

According to the above configuration 13, the thermal conduction path from the tip end portion of the ground electrode to the metal shell is shortened, and thus the heat of the ground electrode can be more smoothly conducted to the metal shell side. As a result, it is possible to suppress the overheating of the ground electrode, and still further improve the wear resistance of the ground electrode.

Configuration 14: In accordance with a fourteenth aspect of the present invention, there is provided a spark plug characterized by being used with an ignition system according to any of the above configurations 1 to 13.

According to the above configuration 14, it basically achieves similar actions and effects to those of the above configuration 1, and the like.

DETAILED DESCRIPTION OF PREFERRED EMBODIMENT

A description will hereinafter be given of embodiments with reference to the drawings.

First Embodiment

Figure 1:
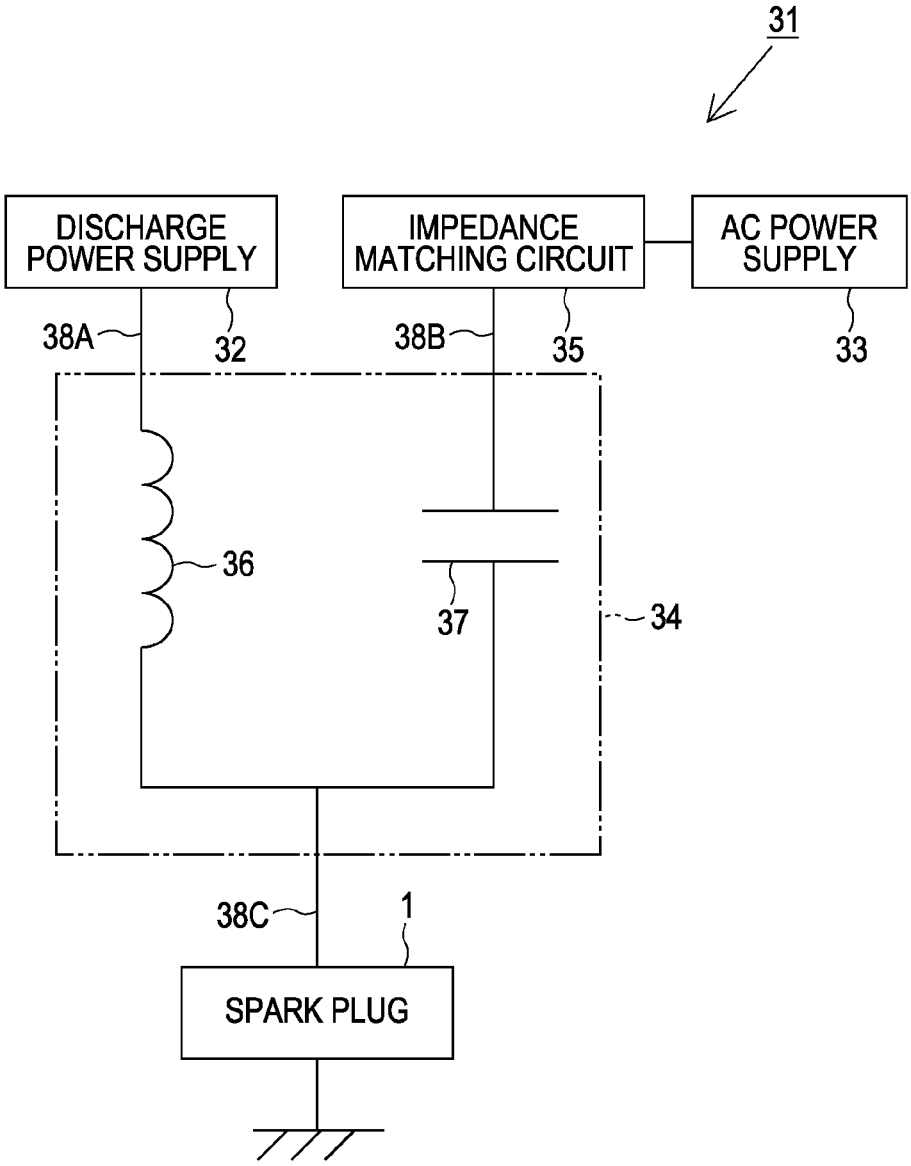
FIG. 1 is a block diagram illustrating the schematic configuration of an ignition system.

FIG. 1 is a block diagram illustrating the schematic configuration of an ignition system 31. In FIG. 1, only one spark plug 1 is illustrated. However, a plurality of cylinders is provided in an actual combustion apparatus, and the spark plug 1 is provided to each cylinder. Power from a discharge power supply 32 and an AC power supply 33, which are described below, is supplied to the spark plugs 1 via a distributor (not illustrated).

The ignition system 31 includes the spark plug 1, the discharge power supply 32, the AC power supply 33, and a mixed circuit 34.

The discharge power supply 32 is for supplying high voltage to the spark plug 1, and generating a spark discharge in a spark discharge gap 28 to be described below. As the discharge power supply 32, for example, an ignition coil can be used.

The AC power supply 33 is for supplying AC power to the spark plug 1. Moreover, an impedance matching circuit 35 is provided between the AC power supply 33 and the mixed circuit 34. It is configured such that the impedance matching circuit 35 causes an output impedance on the AC power supply 33 side to match an input impedance on the mixed circuit 34 and spark plug 1 (load) side, and the prevention of the attenuation of AC power to be supplied to the spark plug 1 side is promoted. The transmission path of AC power from the AC power supply 33 to the spark plug 1 is configured by a coaxial cable including an inner conductor and an outer conductor disposed on the periphery of the inner conductor. As a result, the prevention of the reflection of power is promoted.

The mixed circuit 34 is for combining a transmission path 38A of high voltage to be output from the discharge power supply 32, and a transmission path 38B of AC power to be output from the AC power supply 33 into one transmission path 38C to be connected to the spark plug 1. Mixed circuit 34 includes a coil 36 and a capacitor 37. A relatively low-frequency current to be output from the discharge power supply 32 can pass through the coil 36 while a relatively high-frequency current to be output from the AC power supply 33 cannot pass therethrough. The flow of a current to be output from the AC power supply 33 to the discharge power supply 32 side is suppressed. On the other hand, a relatively high-frequency current to be output from the AC power supply 33 can pass through the capacitor 37 while a relatively low-frequency current to be output from the discharge power supply 32 cannot pass therethrough. The flow of a current to be output from the discharge power supply 32 to the AC power supply 33 side is suppressed. If an ignition coil is used as the discharge power supply 32, a secondary winding of the ignition coil may be used instead of the coil 36, and the coil 36 may be omitted.

Figure 2:
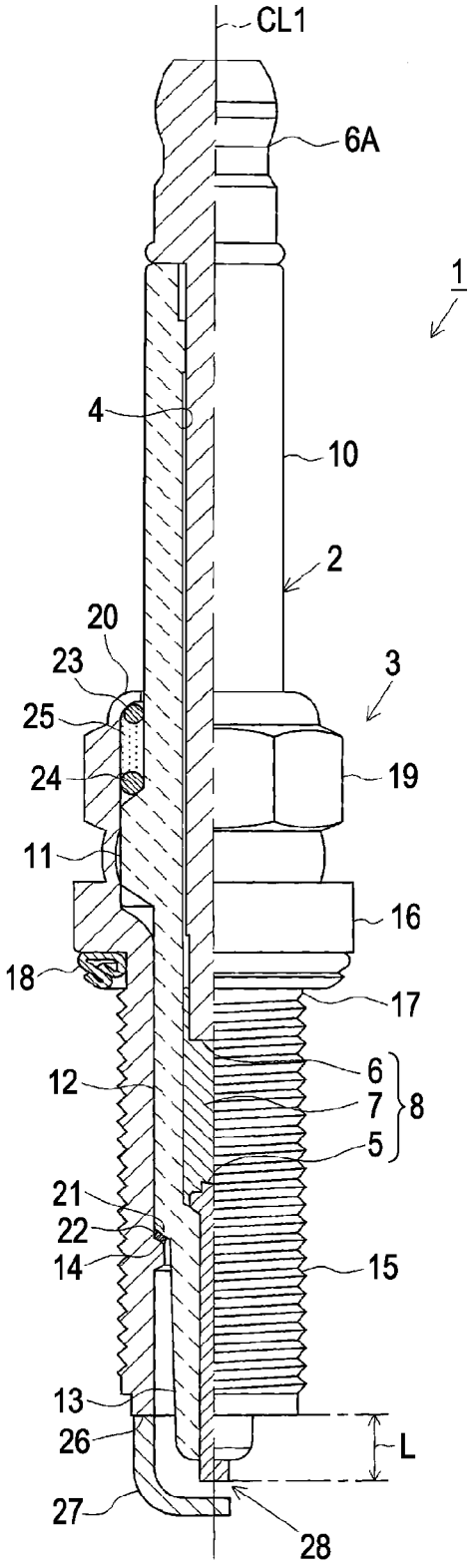
FIG. 2 is a partially sectioned front view illustrating the configuration of a spark plug.

As illustrated in FIG. 2, the spark plug 1 includes an insulator 2, as a tubular insulator, and a tubular metal shell 3 that holds the insulator 2. In FIG. 2, the direction of an axis CL1 of the spark plug 1 is referred to as the vertical direction in the drawing. The lower side is referred to as the tip end side of the spark plug 1, and the upper side as its rear end side.

The insulator 2 is formed from alumina or the like by sintering, as well known in the art. The outer geometry of the insulator 2 includes a rear trunk portion 10 formed on the rear end side of the insulator 2. A large-diameter portion 11 is formed frontward of the rear trunk portion 10 in a manner of protruding radially outward. An intermediate trunk portion 12 is formed frontward of the large-diameter portion 11 and has a smaller diameter than that of the large-diameter portion 11. A leg portion 13 is formed frontward of the intermediate trunk portion 12 with a smaller diameter than that of the intermediate trunk portion 12. In addition, the large-diameter portion 11, the intermediate trunk portion 12, and a great portion of the leg portion 13 of the insulator 2 are accommodated within the metal shell 3. The rear trunk portion 10 is exposed from the rear end of the metal shell 3. Moreover, a tapered step portion 14 is formed at a connection portion between the intermediate trunk portion 12 and the leg portion 13, and the insulator 2 is latched by the metal shell 3 at the step portion 14.

Further, the insulator 2 has an axial hole 4 passing therethrough along the axis CL1. An electrode 8 is fixedly inserted into the axial hole 4. The electrode 8 includes a center electrode 5 provided on the tip end side of the axial hole 4, a terminal electrode 6 provided on the rear end side of the axial hole 4, and a glass seal portion 7 provided between both of the electrodes 5 and 6.

The center electrode 5 has a rod-like shape as a whole. Its tip end protrudes from the tip end of the insulator 2 toward the tip end side in the axis CL1 direction. Moreover, the center electrode 5 includes an Ni alloy that contains nickel (Ni) as a main component. An inner layer including copper or a copper alloy, which is superior in thermal conductivity, may be provided inside the center electrode 5. In this case, the heat conduction of the center electrode 5 is improved, and an improvement in wear resistance can be promoted.

The terminal electrode 6 is formed of a metal such as, by way of example and not limitation, low carbon steel, and has a rod-like shape as a whole. Moreover, the rear end portion of the terminal electrode 6 is provided with a connection portion 6A formed by being expanded radially outward. The connection portion 6A protrudes from the rear end of the insulator 2, and is electrically connected to the output (the transmission path 38C) of the mixed circuit 34.

In addition, the glass seal portion 7 is formed by sintering the mixture of metal powder, glass powder, and the like, and electrically connects the center electrode 5 and the terminal electrode 6 as well as fixing both of the electrodes 5 and 6 to the insulator 2.

The metal shell 3 is formed into a tubular shape from a metal such as low carbon steel. The metal shell 3 has, on its outer peripheral surface, a threaded portion (externally threaded portion) 15 adapted to mount the spark plug 1 into a mounting hole of a combustion apparatus (e.g., an internal combustion engine or a fuel cell reformer). Moreover, the metal shell 3 has, on its outer peripheral surface, a seat portion 16 located rearward of the threaded portion 15. A ring-shaped gasket 18 is fitted to a screw neck 17 at the rear end of the threaded portion 15. Further, the metal shell 3 has, on its rear end side, a tool engagement portion 19 having a hexagonal cross section and allowing a tool, such as a wrench, to be engaged therewith when the metal shell 3 is to be mounted to the combustion apparatus. The metal shell 3 has a crimping portion 20 provided at a rear end portion thereof for retaining the insulator 2.

A tapered step portion 21 is provided on the inner peripheral surface of the metal shell 3 for latching the insulator 2. The insulator 2 is inserted frontward into the metal shell 3 from the rear end side of the metal shell 3. In a state where the step portion 14 of the insulator 2 is latched by the step portion 21 of the metal shell 3, a rear-end opening portion of the metal shell 3 is crimped radially inward. In other words, the above-mentioned crimping portion 20 is formed, to fix, i.e., attach, the insulator 2 to the metal shell 3. An annular sheet packing 22 is disposed between the step portion 14 of the insulator 2 and the step portion 21 of the metal shell 3. This retains the gas tightness of a combustion chamber and prevents an outward leakage of fuel gas that enters the clearance between the inner peripheral surface of the metal shell 3 and the leg portion 13 of the insulator 2, the leg portion 13 being exposed in the combustion chamber.

Further, in order to ensure gas tightness further by crimping, annular ring members 23 and 24 are disposed between the metal shell 3 and the insulator 2 on the rear end side of the metal shell 3, and powder of talc 25 is filled between the ring members 23 and 24. That is, the metal shell 3 holds the insulator 2 via the sheet packing 22, the ring members 23 and 24, and the talc 25.

Moreover, the ground electrode 27 formed of an alloy that contains Ni as a main component and bent at substantially a middle portion thereof is joined to a tip end portion 26 of the metal shell 3. The ground electrode 27 has a side surface on its front end side, the side surface facing a tip end portion of the electrode 8 (the center electrode 5). A spark discharge gap 28 as a gap is formed between the tip end portion of the electrode 8 and the ground electrode 27. In the embodiment, the ground electrode 27 is configured to have the same width along its longitudinal direction.

In the embodiment, it is configured such that voltage from the discharge power supply 32 and AC power from the AC power supply 33 are supplied to the spark discharge gap 28 through the electrode 8, and the AC power from the AC power supply 33 is applied to a spark generated by the voltage from the discharge power supply 32 in the spark discharge gap 28 to generate plasma. That is, it is configured such that the voltage from the discharge power supply 32 and the AC power from the AC power supply 33 are supplied to the spark discharge gap 28 using the electrode 8 as a common transmission path, consequently applying the AC power directly to a spark generated in the spark discharge gap 28.

In addition, when the wavelength of the AC power to be supplied from the AC power supply 33 is set to λ(m), a protruding length L of the tip end of the electrode 8 (the center electrode 5) from the tip end of the metal shell 3 along the axis CL1 is set to λ/8 (m) or less.

Figure 3:
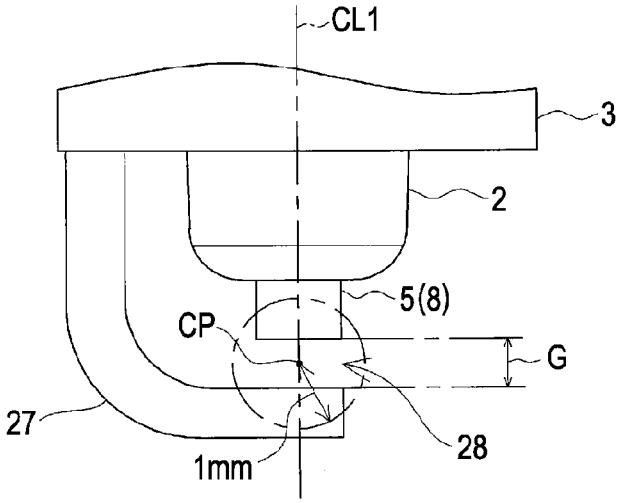
FIG. 3 is an enlarged partial front view illustrating the configuration of a tip end portion of the spark plug.

Further, in the spark plug 1, as illustrated in FIG. 3, a size G of the spark discharge gap 28 is set to 0.5 mm or more and 1.3 mm or less. Moreover, it is configured such that the insulator 2 does not exist in an area with a radius of 1 mm from a center CP of the spark discharge gap 28. "Center CP of the spark discharge gap 28" indicates the midpoint of the line segment connecting the center of a surface of the electrode 8, i.e., the surface facing the ground electrode 27 across the spark discharge gap 28, and the center of a surface of the ground electrode 27, i.e., the surface facing the electrode 8 across the spark discharge gap 28.

In addition, the spark plug 1 is formed in a shape wherein the insulator 2 is sandwiched, i.e., disposed, between the metal shell 3, and the ground electrode 27 and the electrode 8 (in other words, similar to a capacitor that sandwiches an insulator between electrodes); accordingly, the spark plug 1 has electrostatic capacity to some extent. In the embodiment, the length of the metal shell 3 along the axis CL1 and the thickness of the insulator 2 are adjusted to set the electrostatic capacity of a portion of the spark plug 1, the portion being located frontward of the tip end of the metal shell 3 in the axis CL1 direction, equal to or less than one hundredth of the electrostatic capacity of the whole spark plug 1.

Moreover, the oscillation frequency of the AC power to be supplied from the AC power supply 33 is set to 5 MHz or more and 100 MHz or less. Further, the amount of AC power to be applied and the application time of the AC power are adjusted so as to set the average value of AC power to be applied to a spark at one spark discharge (average power) to 50 W or more and 500 W or less.

As described in detail above, according to the embodiment, it is configured such that both the voltage from the discharge power supply 32 and the AC power from the AC power supply 33 pass through the electrode 8 (in other words, pass through the same line) to be supplied to the spark discharge gap 28. Therefore, the AC power is applied directly to a spark, not through a space or the like, and energy can be applied to the spark efficiently. As a result, it is possible to generate larger plasma, and to dramatically improve ignitability.

Moreover, the electrode 8 functions as a common transmission path; accordingly, it is possible to reduce the number of parts, and promote suppression of the manufacturing cost.

Further, when the wavelength of the AC power is set to λ(m), the protruding length L of the tip end of the electrode 8 is made as sufficiently small as λ/8 (m) or less. Therefore, it is possible to prevent the radiation of an electromagnetic wave from the electrode 8 more reliably, and to apply energy to a spark more efficiently. Moreover, it is possible to suppress the overheating of the tip end portion of the electrode 8, and to more reliably prevent situations such as the erosion of the electrode 8 and ignition using the electrode 8 as a heat source.

In addition, the average power is set to 50 W or more and 500 W or less; accordingly, it is possible to generate plasma more reliably as well as suppressing the sudden wear of the electrode 8 effectively. As a result, stable ignitability can be promoted, and excellent ignitability can be maintained for a longer period of time.

In addition, the size G of the spark discharge gap 28 is set to 1.3 mm or less; accordingly, the spark resistance of a generated spark can be made sufficiently small. Consequently, the flow of AC power to a spark can be facilitated, and ignitability can be still further improved. On the other hand, the size G of the spark discharge gap 28 is set to 0.5 mm or more; accordingly, it is possible to more reliably prevent the generation of a bridge between the tip end portion of the electrode 8 and the ground electrode 27.

Moreover, it is configured such that the insulator 2 does not exist in an area with a radius of 1 mm from the center CP of the spark discharge gap 28, and a spark discharge is generated at a position away from the insulator 2. Therefore, it is possible to more reliably prevent a foreign object such as carbon from accumulating on the surface of the insulator 2, and to suppress leakage of current more reliably.

Further, the oscillation frequency of the AC power is made as sufficiently high as 5 MHz or more; accordingly, there will be no need to excessively increase the electrostatic capacity of the capacitor 37 to permit the passage of the AC power, which leads to the prevention of flow of current to be output from the discharge power supply 32 to the AC power supply 33 side. As a result, it is possible to prevent more reliably the breakage of the AC power supply 33, as well as applying energy to a spark more efficiently. On the other hand, the oscillation frequency of the AC power is set to 100 MHz or less; accordingly, the suppression of an increase in electrical resistance in the transmission path of the AC power supply 33 can be promoted, and ignitability can be further improved.

In addition, the electrostatic capacity of a portion of the spark plug 1, the portion being located frontward of the tip end of the metal shell 3, is made as very small as one hundredth of the electrostatic capacity of the whole spark plug 1. Hence, it is possible to suppress the reflection of power to a minimum, and to promote a further improvement in ignitability.

Figure 4:
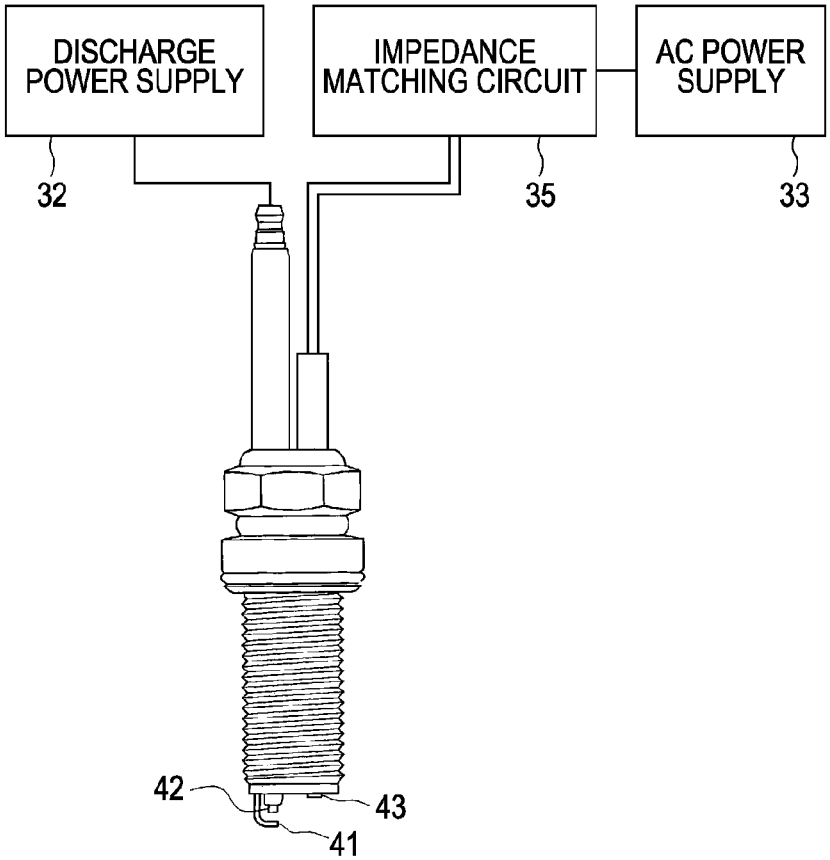
FIG. 4 is a schematic drawing illustrating the configuration of a sample corresponding to a comparative example.
Figure 5:
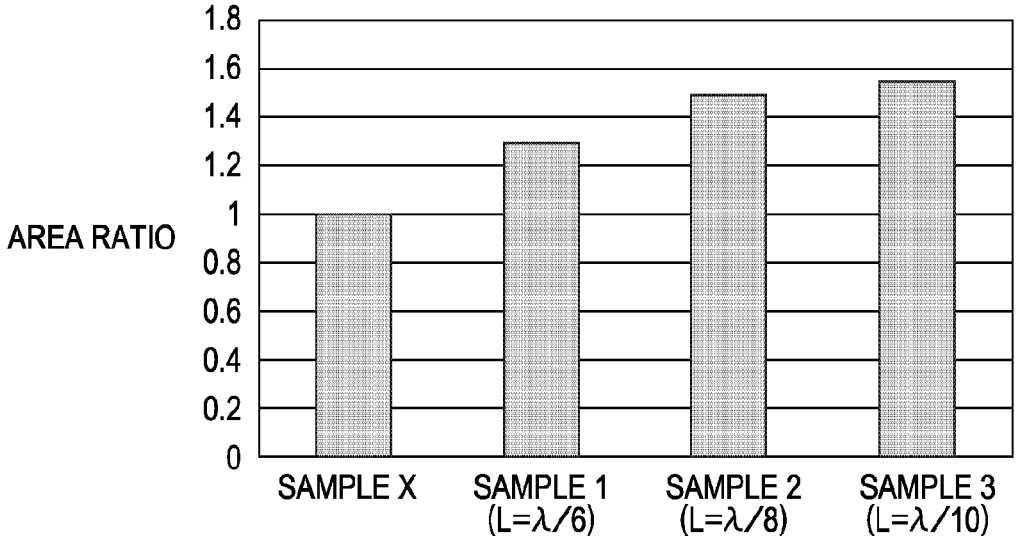
FIG. 5 is a graph illustrating the results of an ignitability evaluation test for samples that are different in the protruding length L of a center electrode from one another.

Next, in order to confirm the action and effect achieved by the above embodiment, an ignitability evaluation test was carried out on samples manufactured as follows. Samples of spark plugs that are different in the protruding length L of the electrode (center electrode) along the axis (which correspond to the present invention), and a sample of a spark plug that separately includes, as illustrated in FIG. 4, an electrode 42, connected to the discharge power supply 32, for generating a spark between its tip end portion and a ground electrode 41, and an antenna 43, connected to the AC power supply 33, for radiating an electromagnetic wave at its tip end portion and applying high-frequency energy to a spark through a space (which corresponds to a comparative example) were manufactured. The following is the summary of the ignitability evaluation test. That is, the samples were attached to a predetermined chamber, and plasma was generated with the oscillation frequency of the AC power set to 2.45 GHz and the output of the AC power supply set to 500 mJ as well as images of the generated plasma were captured from the side surfaces of the samples. The sizes of the plasma (plasma areas) were measured from the captured images. The ratio (area ratio) of the plasma area of the sample corresponding to the present invention to the plasma area of the sample corresponding to the comparative example was calculated. FIG. 5 illustrates the results of the test. In FIG. 5, a sample X indicates the sample corresponding to the comparative example. Moreover, samples 1 to 3 indicate the samples corresponding to the present invention, respectively. The sample 1 has a protruding length L of $\lambda/6$ (m). The sample 2 has a protruding length L of $\lambda/8$ (m). The sample 3 has a protruding length L of $\lambda/10$ (m) ($\lambda$ represents the wavelength of the AC power).

As illustrated in FIG. 5, it became clear that the samples corresponding to the present invention (the samples 1 to 3) increased their plasma areas compared with the sample corresponding to the comparative example (the sample X) and had excellent ignitability, respectively. Conceivably, this is because the AC power was applied directly to the spark, not through a space, to eliminate the loss of energy that would otherwise have been caused by the mediation of the space.

Moreover, it is found that the samples in which the protruding length L was set to $\lambda/8$ (m) or less (the samples 2 and 3) could realize more excellent ignitability. Conceivably, this is because the protruding length L was set to $\lambda/8$ or less to effectively suppress the radiation of an electromagnetic wave from the electrode and increase energy applied to the spark.

From the above test results, it can be said that the voltage from the discharge power supply and the AC power from the AC power supply are preferably supplied to the spark discharge gap by use of the electrode as a common transmission path in order to promote an improvement in ignitability. Moreover, from the viewpoint of promoting a further improvement in ignitability, it can be said that it is more preferable to set the protruding length L of the electrode to $\lambda/8$ (m) or less.

Next, a durability evaluation test and a misfire rate measurement test were carried out on samples of spark plugs in which the average value of the AC power to be applied to a spark (average power) could be changed by changing the output current of the AC power supply.

The following is the summary of the durability evaluation test. That is, the spark plugs of the samples were attached to a predetermined chamber, and plasma was generated with the pressure inside the chamber set to 0.4 MPa and the frequency of the applied voltage set to 15 Hz (that is, at a rate of 900 times per minute). The sizes of the spark discharge gaps after the test were measured after a lapse of 40 hours, and the amounts of increases in the sizes of the spark discharge gaps before the test (the gap increased amounts) were calculated. A sample in which the gap increased amount resulted in 0.1 mm or less had a very low wearing rate of the electrode, and could suppress an increase in spark discharge voltage very effectively. Therefore, it was evaluated as "excellent." A sample in which the gap increased amount resulted in larger than 0.1 mm to 0.2 mm or less had a low wearing rate of the electrode, and could suppress an increase in spark discharge voltage effectively. Therefore, it was evaluated as "good." On the other hand, a sample in which the gap increased amount resulted in larger than 0.2 mm to 0.3 mm or less had a slightly high wearing rate of the electrode, and the spark discharge voltage was slightly likely to increase. Therefore, it was evaluated as "fair."

Moreover, the following is the summary of the misfire rate measurement test. That is, the spark plugs of the samples were attached to a 4-cylinder DOHC engine having a displacement of 2000 cc, and the Air/Fuel ratio (A/F) was set to 24. Voltage was applied to generate a spark, and AC power was applied to the spark. This operation was repeated 1000 times to measure the number of failures in the ignition of the air-fuel mixture (the number of misfires) and calculate the rate of the number of misfires in 1000 times (a misfire rate). A sample in which the misfire rate resulted in 0.0% could ignite the air-fuel mixture very stably and was therefore evaluated as "excellent." A sample in which the misfire rate resulted in 0.1% or more and 0.9% or less could ignite the air-fuel mixture sufficiently stably and was therefore evaluated as "good." On the other hand, a sample in which the misfire rate resulted in 1.0% or more was slightly inferior in the stability of ignition and was therefore evaluated as "fair."

Table 2 shows the results of the durability evaluation test and the misfire rate measurement test. In both of the tests, for each sample, the oscillation frequency of AC power was set to 13.56 MHz, and the application time of AC power for one spark discharge was set to 2 ms. Moreover, the tip end portion of the electrode (the center electrode) included a Ni alloy, the outside diameter of the tip end portion of the electrode was set to 2.5 mm, and the size of the gap to 0.8 mm. In Table 2, the average power is 0 W, which indicates that only a spark was generated without applying the AC power.

TABLE 2

| | Average power (W) | | | | | |
|---|---|---|---|---|---|---|
| | 0 | 30 | 50 | 250 | 500 | 600 |
| Durability evaluation | Excellent | Good | Good | Good | Good | Fair |
| Misfire rate evaluation | Fair | Good | Excellent | Excellent | Excellent | Excellent |

As shown in Table 2, it became clear that setting the average power to 50 W or more and 500 W or less makes it possible to suppress an increase in spark discharge voltage effectively and to ignite the air-fuel mixture very stably.

From the above test results, it can be said that, from the viewpoint of enabling ignition for a long period of time and realizing the excellent ignition stability, it is preferable to set the average value of AC power (average power) to be applied to a spark to 50 W or more and 500 W or less.

Figure 6:
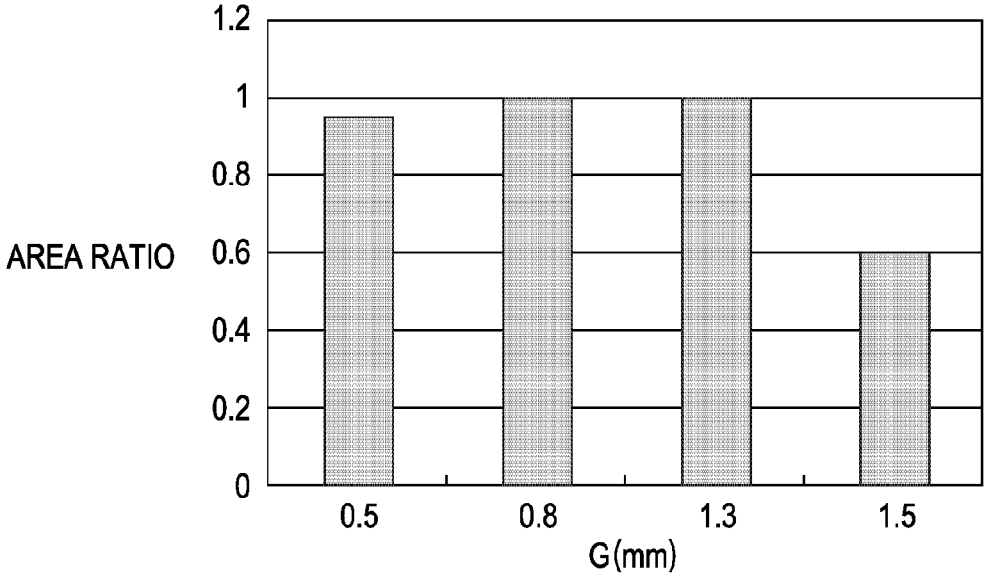
FIG. 6 is a graph illustrating the results of an ignitability evaluation test for samples that are different in the size G of a spark discharge gap from one another.

Next, a plurality of samples of spark plugs, in which the size G of the spark discharge gap was different, was manufactured, and the above-mentioned ignitability evaluation test was carried out on the samples. Herein, the oscillation frequency of the AC power was changed to 13.56 MHz, the application time of the AC power for one spark discharge was set to 2 ms, and the average power to 300 W. Moreover, the plasma area of the sample in which the size G of the spark discharge gap was set to 1.0 mm was set to be a reference, and the area ratios of the samples were calculated. FIG. 6 illustrates the results of the test.

As illustrated in FIG. 6, it was found that the sample in which the size G of the spark discharge gap was set to 1.5 mm was slightly inferior in ignitability to the other samples. Conceivably, this is because the spark resistance of the generated spark became relatively large, and the AC power was unlikely to flow to the spark.

In contrast, it became clear that the samples in which the size G was set to 1.3 mm or less were superior in ignitability. Moreover, it was confirmed that especially the samples in which the size G was set to 0.8 mm or more and 1.3 mm or less were more superior in ignitability.

From the above test results, it can be said that is preferable to set the size G of the spark discharge gap to 1.3 mm or less to promote a further improvement in ignitability. Moreover, it can be said that it is more preferable to set the size G of the spark discharge gap to 0.8 mm or more and 1.3 mm or less to further improve ignitability.

Next, samples of spark plugs in which a shortest distance X from the center of the spark discharge gap to the insulator was set to 0.5 mm, 1 mm, or 1.5 mm by changing the protruding length of the tip end of the electrode from the tip end of the insulator were manufactured. After the above-mentioned durability evaluation test was carried out on the samples, and their fouled conditions of the surfaces of the insulators were checked. After a lapse of 40 hours, a sample in which abnormality did not occur to the insulator was evaluated as "good," while a sample in which a foreign object such as carbon accumulated on the surface of the insulator was evaluated as "fair." Table 3 shows the results of the test. In the test, the oscillation frequency of the AC power, the size of the electrode, and the like were set to be the same as the oscillation frequency, the size of the electrode, and the like in the above-mentioned durability evaluation test.

TABLE 3

| | Shortest distance X (mm) | | |
|---|---|---|---|
| | 0.5 | 1 | 1.5 |
| Fouling characteristic evaluation | Fair | Good | Good |

As shown in Table 3, it was confirmed that the foreign object accumulated on the surface of the insulator of the sample in which the shortest distance X was set to 0.5 mm Conceivably, this is because the generated plasma was likely to come into contact with the insulator and the surface of the insulator was subjected to higher temperature.

In contrast, it was found that an abnormality did not occur to the insulators of the samples in which the shortest distance X was set to 1 mm or more even after a lapse of 40 hours, and they could suppress the accumulation of a foreign object effectively.

From the above test results, it can be said that it is preferable to set the shortest distance X to 1 mm or more, in other words, to be configured such that an insulator does not exist within an area of 1 mm from the center of a spark discharge gap, to promote the prevention of the accumulation of a foreign object.

Second Embodiment

Next, a description will be given of a second embodiment. In the second embodiment, especially the configuration of the spark plug 1 is different from that of the above first embodiment. Accordingly, a description will be given of the configuration of the spark plug 1.

Figure 7:
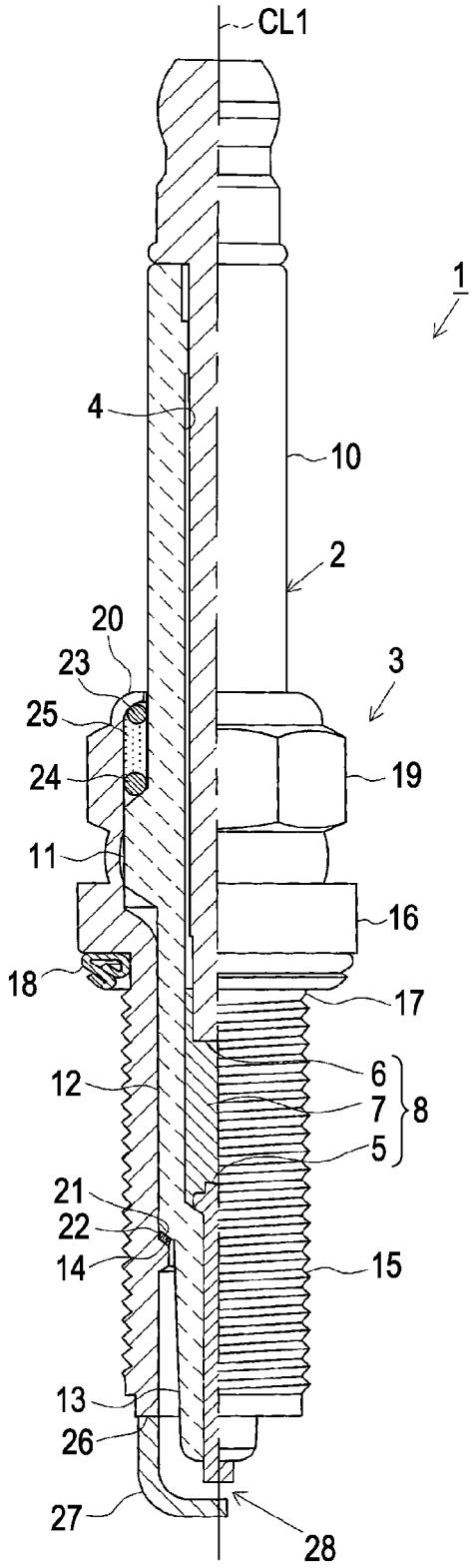
FIG. 7 is a partially sectioned front view illustrating the configuration of a spark plug according to a second embodiment.
Figure 8:
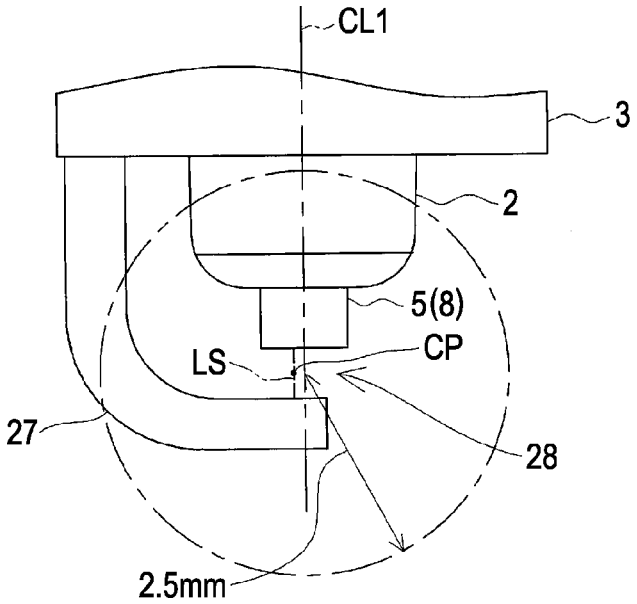
FIG. 8 is an enlarged partial front view illustrating the configuration of a tip end portion of the spark plug.

As illustrated in FIGS. 7 and 8, in the embodiment, the total volume of portions of the electrode 8, the ground electrode 27, and the insulator 2, the portions being located in an area with a radius of 2.5 mm from the center CP of the spark discharge gap 28, is set to 20 $mm^3$ or less. Moreover, in the embodiment, the size of the spark discharge gap 28 (the length of a line segment LS to be described below) is made relatively large (e.g., 0.5 mm or more), and it is configured such that the electrode 8 and the ground electrode 27 are relatively away from the center CP. Further, the shortest distance from the tip end of the metal shell 3 to the center CP of the spark discharge gap 28 is set to 2.5 mm or more, and it is configured such that the metal shell 3 does not exist within the above area.

Figure 9:
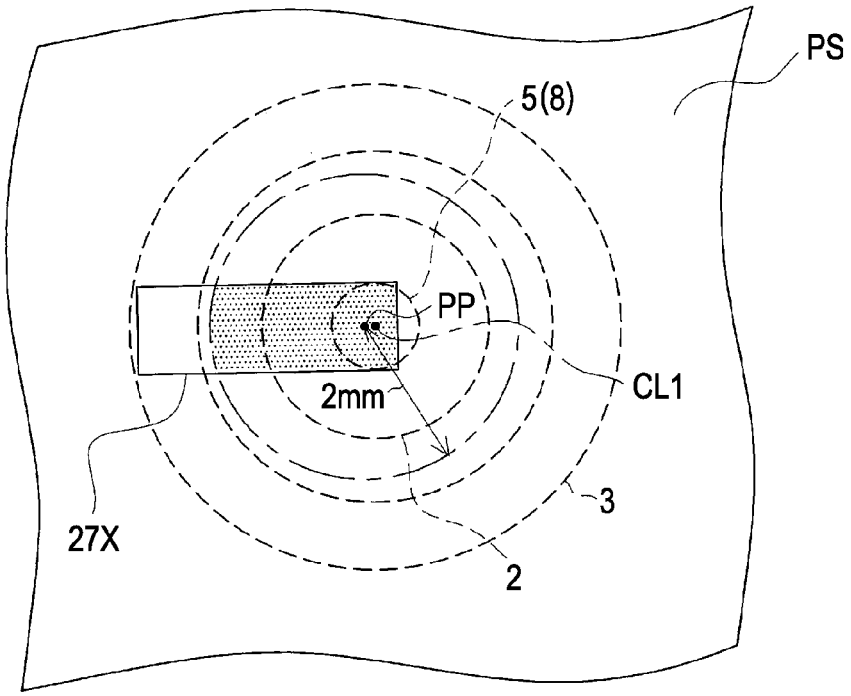
FIG. 9 is a projection view illustrating a projection plane where a ground electrode and the like are projected.

Moreover, on a projection plane PS (refer to FIG. 9) developed by projecting the ground electrode 27 and the center CP of the spark discharge gap 28 on a surface orthogonal to the line segment LS linking the electrode 8 and the ground electrode 27 and forming the shortest distance of the spark discharge gap 28 with respect to a direction in which the line segment LS extends, the area of a region located in an area with a radius of 2 mm from a projection point PP of the center CP of the spark discharge gap 28 (a portion of a scattered pattern in FIG. 9) in a projection region 27X of the ground electrode 27 is set to 7.6 $mm^2$ or less.

Figure 10A:
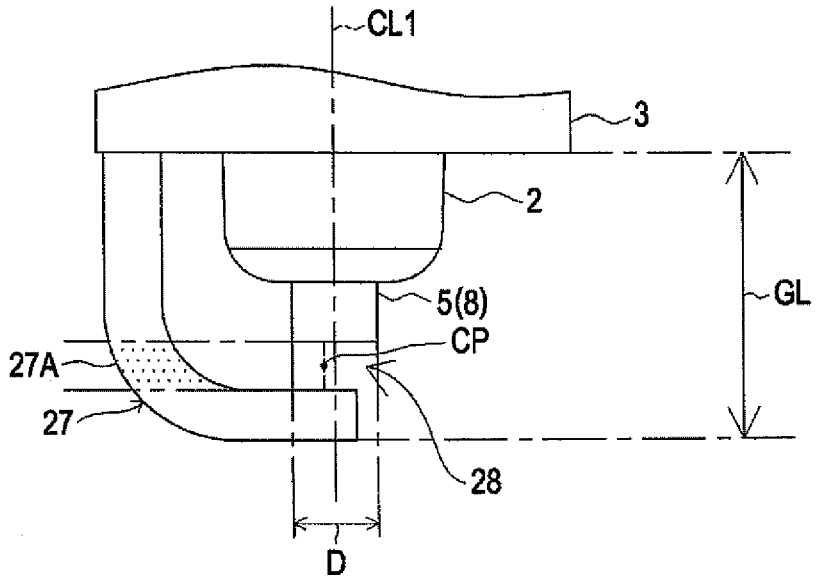
FIG. 10(*a*) is an enlarged partial front view illustrating the configuration of the tip end portion of the spark plug, and FIG. 10(*b*) is an enlarged partial side view illustrating the configuration of the tip end portion of the spark plug.
Figure 10B:
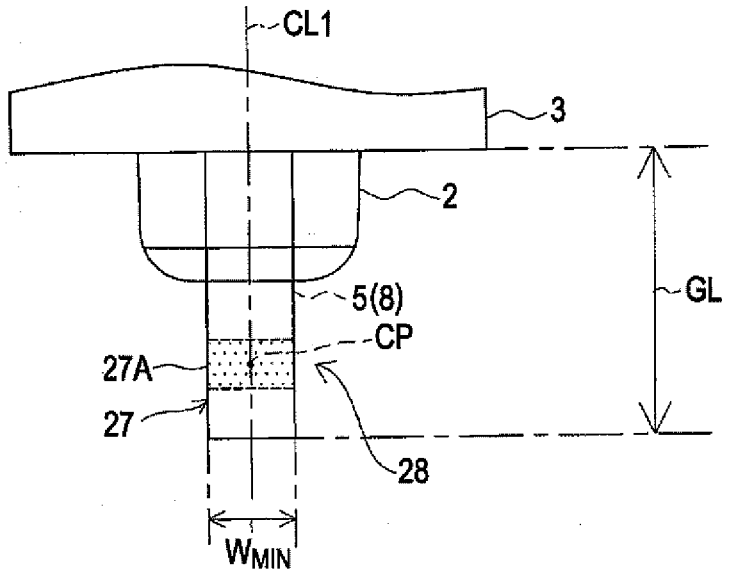

Further, as illustrated in FIGS. 10(*a*) and 10(*b*), an outside diameter D of the tip end portion of the electrode 8 (the center electrode 5) is made as relatively small as 3.0 mm or less. It is preferable that the outside diameter D be set to 0.5 mm or more to ensure the wear resistance of the electrode 8.

Moreover, a minimum width $W_{MIN}$ of a gap corresponding portion 27A of the ground electrode 27, the gap corresponding portion 27A corresponding to the spark discharge gap 28 in the axis CL1 direction, is set to 3.0 mm or less. In addition, a protruding length GL of the ground electrode 27 from the tip end of the metal shell 3 along the axis CL1 is set to 10 mm or less.

Figure 11:
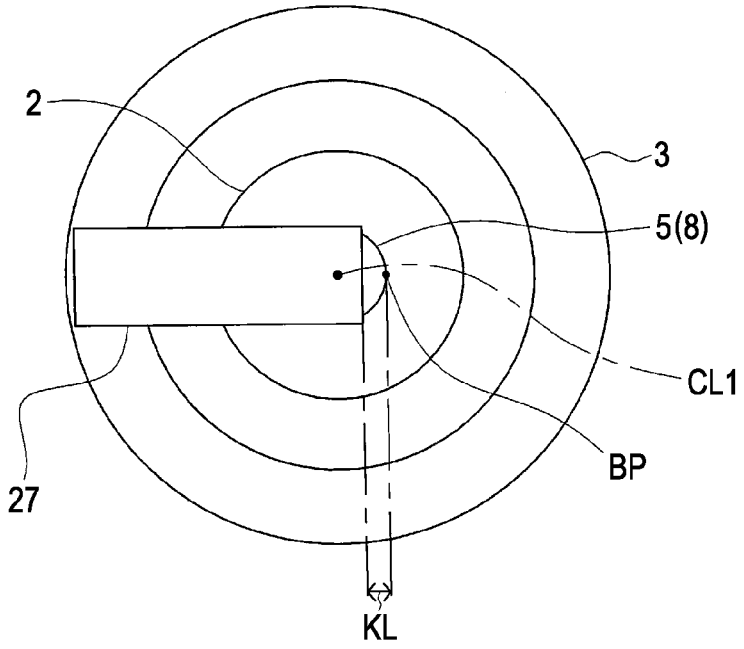
FIG. 11 is an enlarged partial bottom view illustrating the configuration of the tip end portion of the spark plug.

Further, in the embodiment, as illustrated in FIG. 11, with regard to a distance KL, along a direction in which the ground electrode 27 extends, between a portion BP of the outer periphery of the tip end surface of the electrode 8, the portion BP being farthest away from a proximal end of the ground electrode 27, and the tip end of the ground electrode 27 when viewed from the tip end side in the axis CL1 direction, assuming that the proximal end side of the ground electrode 27 is a minus side relative to the portion BP, the distance KL is set to be minus Consequently, at least part of the tip end surface of the electrode 8 can be visually identified when viewed from the tip end side in the axis CL1 direction. If the distance KL is set to 0 or plus, for example, the width of a portion of the ground electrode 27, the portion being located above the tip end portion of the electrode 8, is made smaller than the outside diameter D of the tip end of the electrode 8. Accordingly, at least part of the tip end surface of the electrode 8 can be visually identified when viewed from the tip end side in the axis CL1 direction.

As described in detail above, according to the embodiment, the total volume of the electrode 8, the ground electrode 27, and the insulator 2 is set to 20 $mm^3$ or less in a very wide area, i.e., an area with a radius of 2.5 mm from the center CP of the spark discharge gap 28. That is, the total volume of the electrode 8, the ground electrode 27, and the like is made sufficiently small within an area where plasma can be generated. Larger plasma can be therefore generated immediately after the application of the AC power while being prevented as much as possible from the inhibition by the electrode 8, the ground electrode 27, and the like. As a result, ignitability can be dramatically improved.

Moreover, the area of the projection region 27X of the ground electrode 27, which is located in an area with a radius of 2 mm from the projection point PP of the center CP of the spark discharge gap 28 on the projection plane PS, is set to 7.6 $mm^2$ or less. Consequently, the inhibition of the growth of plasma by the ground electrode 27 can be more reliably suppressed, and much larger plasma can be generated.

Further, the minimum width $W_{MIN}$ of the gap corresponding portion 28A of the ground electrode 27, the gap corresponding portion 28A corresponding to the spark discharge gap 28, is set to 3.0 mm or less, and the airflow can be made easy to flow into the spark discharge gap 28. As a result, plasma can be grown more largely, carried by the airflow, and ignitability can be still further improved.

In addition, it is configured in the embodiment such that at least part of the tip end surface of the electrode 8 can be visually identified when viewed from the tip end side in the axis CL1 direction. Accordingly, plasma can be made easy to spread wider toward the center side of the combustion chamber. As a result, ignitability can be still further improved.

In addition, the outside diameter D of the tip end portion of the electrode 8 is set to 3.0 mm or less. Accordingly, it is possible to effectively suppress the inhibition of the growth of plasma by the tip end portion of the electrode 8, and to promote a further improvement in ignitability.

Moreover, it is configured such that the protruding length GL of the ground electrode 27 is set to 10 mm or less, and the thermal conduction path from the tip end portion of the ground electrode 27 to the metal shell 3 is short. As a result, it is possible to conduct the heat of the ground electrode 27 more smoothly to the metal shell 3 side, and to still further improve the wear resistance of the ground electrode 27.

Figure 12:
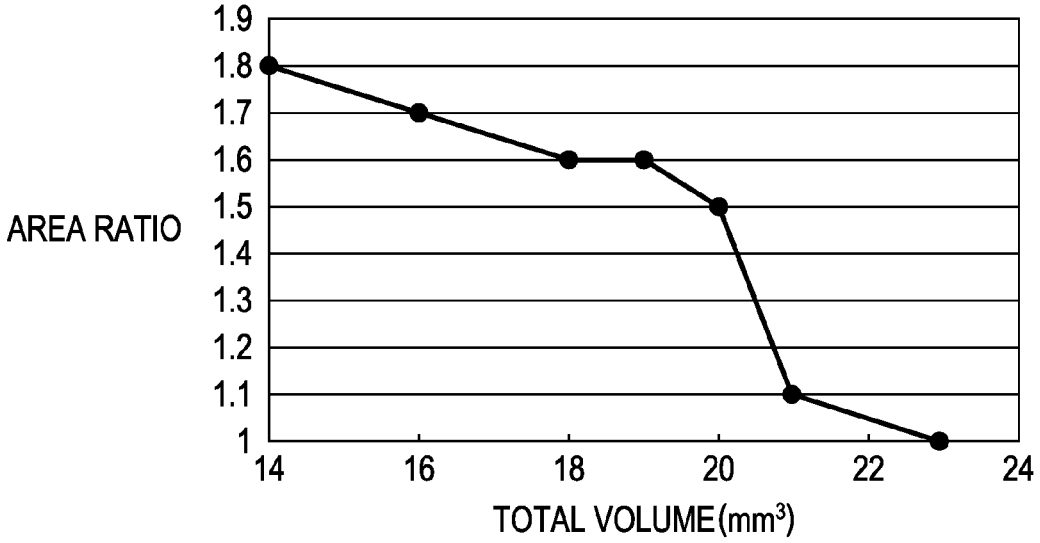
FIG. 12 is a graph illustrating the results of an ignitability evaluation test for samples that are different in total volume from one another.

Next, in order to confirm the action and effect achieved by the second embodiment, an ignitability evaluation test was carried out on samples of spark plugs manufactured as follows. Each sample had a different total volume of portions located in an area with a radius of 2.5 mm from the center of the spark discharge gap among the electrode, the ground electrode, and the insulator by changing the outside diameter D of the tip end portion of the electrode, the size of the spark discharge gap (the gap length), and the distance KL. The following is the summary of the ignitability evaluation test. That is, the samples were attached to a predetermined chamber. Power was applied to the samples for 1 ms from an AC power supply in which the oscillation frequency was set to 13 MHz, and the output power (an average value per second of the amount of applied power) to 300 W to generate plasma. The images of generated plasma were captured from the side surfaces of the samples. The sizes of the plasma (plasma areas) were measured from the captured images. Moreover, the ratio of the plasma area (area ratio) of each sample to the plasma area of the sample where the total volume was set to 23 $mm^3$ was calculated. FIG. 12 is a graph illustrating a relationship between the total volume and the area ratio. The outside diameter D, the gap length, and the distance KL of the samples are shown in Table 4.

TABLE 4

| Total Volume ($mm^3$) | Outside diameter D (mm) | Gap length (mm) | Distance KL (mm) |
|---|---|---|---|
| 14 | 0.6 | 0.8 | 0.6 |
| 16 | 2.5 | 1.3 | −1.0 |
| 18 | 2.5 | 1.3 | −0.5 |
| 19 | 2.5 | 0.8 | −1.0 |
| 20 | 2.5 | 1.3 | 0 |
| 21 | 2.5 | 0.8 | −0.5 |
| 23 | 2.5 | 0.8 | 0 |

As illustrated in FIG. 12, it became clear that the area ratio suddenly increases by setting the total volume to 20 $mm^3$ or less and ignitability can be dramatically improved. Conceivably, this is because a reduction in the volume of the electrode and the like in a wide area corresponding to a plasma generation region made it possible to generate larger plasma without being inhibited by the electrode and the like.

From the above test results, it can be said that ignitability can be dramatically improved in a spark plug that generates plasma, by setting the total volume of portions located in an area with a radius of 2.5 mm from the center of a spark discharge gap among an electrode, a ground electrode, and an insulator to 20 $mm^3$ mm or less.

Figure 13:
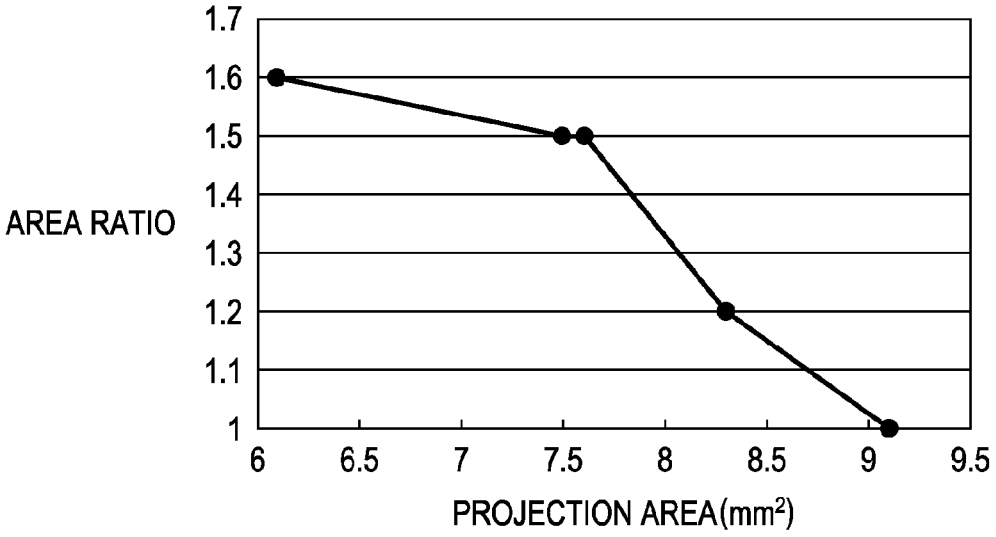
FIG. 13 is a graph illustrating the results of an ignitability evaluation test for samples that are different in projection area from one another.

Next, the above-mentioned ignitability evaluation test was carried out on samples of spark plugs manufactured as follows. Each sample had a different area of a projection region (projection area) of the ground electrode, which is located in an area with a radius of 2 mm from the projection point at the center of the spark discharge gap, on the projection plane by changing the width of the ground electrode, and the distance KL. FIG. 13 is a graph illustrating a relationship between the projection area and the area ratio. The area ratio was calculated with the sample in which the projection area was set to 9.1 $mm^2$ as a reference. Moreover, for each sample, the total volume was set to 20 $mm^3$ or less as well as the outside diameter D of the tip end portion of the electrode was set to 2.5 mm, and the gap length to 1.3 mm. In addition, the widths of the ground electrode, and the distances KL of the samples are shown in Table 5.

TABLE 5

| Projection area ($mm^2$) | Width of ground electrode (mm) | Distance KL (mm) |
|---|---|---|
| 6.1 | 3.0 | −1.0 |
| 7.5 | 2.7 | −0.3 |
| 7.6 | 3.0 | −0.5 |
| 8.3 | 2.7 | 0.0 |
| 9.1 | 3.0 | 0.0 |

As illustrated in FIG. 13, it was found that the samples in which the projection area was set to 7.6 $mm^2$ or less were especially superior in ignitability. Conceivably, this is because a relative reduction in projection area enabled the generation of larger plasma without being inhibited by the ground electrode immediately after the application of the power.

From the above test results, it can be said that it is preferable to set the projection area to 7.6 $mm^2$ or less to promote a further improvement in ignitability.

Figure 14:
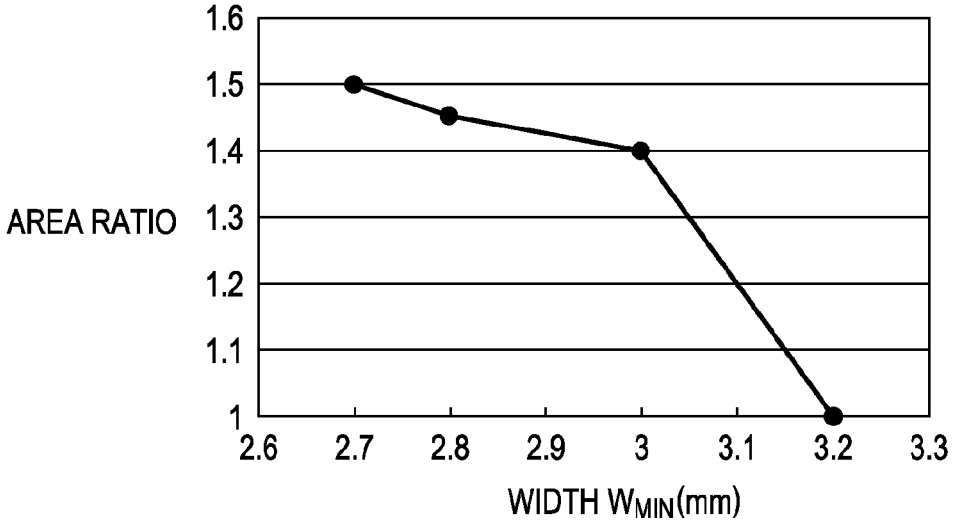
FIG. 14 is a graph illustrating the results of an ignitability evaluation test for samples that are different in the minimum width of a gap corresponding portion from one another.

Next, samples of spark plugs in which the minimum width $W_{MIN}$ of the gap corresponding portion was different were manufactured, and an ignitability evaluation test was carried out on the samples. FIG. 14 is a graph illustrating a relationship between the minimum width $W_{MIN}$ and the area ratio. The area ratio was calculated with the sample in which the minimum width $W_{MIN}$ was set to 3.2 mm as a reference. Moreover, for each sample, the total volume was set to 20 $mm^3$ or less as well as the outside diameter D of the tip end portion of the electrode was set to 2.5 mm, the gap length to 1.3 mm, and the distance KL to −0.5 mm. The test was carried out in a state where the air at a velocity of 4 m/s to 6 m/s was blown from the back side of the gap corresponding portion toward the spark discharge gap. Moreover, each sample was configured such that the ground electrode had the same width along its longitudinal direction (the same shall apply in the following test).

As illustrated in FIG. 14, it became clear that the samples in which the minimum width $W_{MIN}$ of the gap corresponding portion was set to 3.0 mm or less were more superior in ignitability. Conceivably, this is because the facilitation of flow of air into the spark discharge gap causes plasma to be blown by the air and grow more largely.

From the above test results, it can be said that it is more preferable to set the minimum width $W_{MIN}$ of the gap corresponding portion to 3.0 mm or less to sill further improve ignitability.

Next, samples of spark plugs in which the outside diameter D of the tip end portion of the electrode was different were manufactured, and an ignitability evaluation test was carried out on the samples. Table 6 shows the results of the test. The area ratio was calculated with the sample in which the outside diameter D was reduced to 1.0 mm and ignitability was very superior as a reference. Moreover, a sample in which the area ratio resulted in 0.7 or more and 1.0 or less was sufficiently superior in ignitability and was therefore evaluated as "excellent." A sample in which the area ratio resulted in 0.5 or more and less than 0.7 was slightly inferior in ignitability to the other samples but was still superior in ignitability and was therefore evaluated as "good." The samples were configured such that the gap length was set to 0.8 mm and the width of the ground electrode to 1.0 mm, and the tip end portion of the electrode included a platinum alloy. Moreover, the total volume was set to 20 $mm^3$ or less, and the time of applying power to the samples to 2.0 ms.

TABLE 6

| | Outside diameter D (mm) | | | |
|---|---|---|---|---|
| | 1.0 | 2.0 | 3.0 | 3.5 |
| Ignitability evaluation | Excellent | Excellent | Excellent | Good |

As shown in Table 6, it became clear that the samples were superior in ignitability, but the samples in which the outside diameter D was set to 3.0 mm or less were especially superior in ignitability. Conceivably, this is because a relative reduction in the diameter of the tip end portion of the electrode made it possible to generate larger plasma without being inhibited by the electrode.

From the above test results, it can be said that it is more preferable to set the outside diameter D of the tip end portion of the electrode to 3.0 mm or less to further improve ignitability.

Next, a plurality of samples of spark plugs in which the minimum width $W_{MIN}$ of the gap corresponding portion was different was manufactured, and a durability evaluation test was carried out on the samples. The following is the summary of the durability evaluation test. That is, the ground electrodes of the samples were heated under the condition that the temperature of the tip end portion of the ground electrode of the sample in which the minimum width $W_{MIN}$ was set to 2.0 mm became 800° C. The temperatures of the tip end portions of the ground electrodes at heating were measured. A sample in which the temperature of the tip end portion of the ground electrode became 800° C. or more and 900° C. or less could conduct the heat of the ground electrode sufficiently, and was sufficiently superior in durability. Therefore, it was evaluated as "excellent." On the other hand, a sample in which the temperature of the tip end portion became over 900° C. to 1000° C. or less was slightly more likely to be subjected to high temperature than the other samples, but was still superior in durability. Therefore, it was evaluated as "good." Table 7 shows the results of the test.

TABLE 7

| | Minimum width $W_{MIN}$ (mm) | | |
|---|---|---|---|
| | 0.8 | 1.0 | 2.0 |
| Durability evaluation | Good | Excellent | Excellent |

As shown in Table 7, it became clear that the samples in which the minimum width $W_{MIN}$ was set to 1.0 mm or more were especially superior in durability. Conceivably, this is because the cross-sectional area of the ground electrode was sufficiently ensured and the heat of the ground electrode was conducted more smoothly to the metal shell side.

Next, a plurality of samples of spark plugs in which the protruding length GL of the ground electrode from the tip end of the metal shell was different was manufactured, and the above-mentioned durability evaluation test was carried out on the samples. In this test, the ground electrodes of the samples were heated under the condition that the temperature of the tip end portion of the ground electrode of the sample in which the protruding length GL was set to 7 mm became 800° C. Table 8 shows the results of the test. The width of the ground electrode was set to 1.0 mm for each sample.

TABLE 8

| | Protruding length GL (mm) | | | |
|---|---|---|---|---|
| | 7 | 9 | 10 | 11 |
| Durability evaluation | Excellent | Excellent | Excellent | Good |

As shown in Table 8, it became clear that the samples in which the protruding length GL was set to 10 mm or less were more superior in durability. Conceivably, this is because a relative reduction in protruding length GL shortened the thermal conduction path from the tip end portion of the ground electrode to the metal shell and accordingly the heat of the ground electrode could be conducted more smoothly to the metal shell side.

Next, a plurality of samples of spark plugs in which the outside diameter D of the tip end portion of the electrode was different was manufactured, and a wear resistance evaluation test was carried out on the samples. The following is the summary of the wear resistance evaluation test. That is, the samples were attached to a predetermined chamber, and plasma was generated with the pressure inside the chamber set to 0.4 MPa, and the frequency of the applied voltage set to 15 Hz (that is, at a rate of 900 times per minute). The sizes of the spark discharge gaps after the test were measured after a lapse of 40 hours, and the amounts of increases in the sizes of the spark discharge gaps before the test (the gap increased amounts) were calculated. A sample in which the gap increased amount resulted in 0.2 mm or less had a very low wearing rate of the electrode, and could suppress an increase in spark discharge voltage effectively. Therefore, it was evaluated as "excellent". A sample in which the gap increased amount resulted in over 0.2 mm to 0.3 mm or less could suppress an increase in spark discharge voltage sufficiently. Therefore, it was evaluated as "good". Table 9 shows the results of the test. The samples were configured such that the gap length was set to 0.8 mm and the width of the ground electrode to 1.0 mm, and the tip end portion of the electrode included a platinum alloy. Moreover, the total volume was set to 20 $mm^3$ or less, and the time of applying power to the samples to 2.0 ms.

TABLE 9

| | Outside diameter D (mm) | | |
|---|---|---|---|
| | 0.4 | 0.5 | 1.0 |
| Wear resistance evaluation | Good | Excellent | Excellent |

As shown in Table 9, it was found that the wear of the electrode with use was suppressed by setting the outside diameter D to 0.5 mm or more, and the suppression of an increase in spark discharge voltage, and a prolongation of the duration during which plasma can be generated, can be promoted.

From the results of the above durability evaluation test and the wear resistance evaluation test, it can be said that it is preferable to set the minimum width $W_{MIN}$ of the ground electrode to 1.0 mm or more, the protruding length SL of the ground electrode to 10 mm or less, and the outside diameter D of the tip end portion of the electrode to 0.5 mm or more in order to improve the durability of the electrode and the ground electrode and enable the generation of plasma for a longer period of time.

The present invention is not limited to the above embodiments, but may be embodied, for example, as follows. Naturally, applications and modifications other than those exemplified below are also possible.

Figure 15:
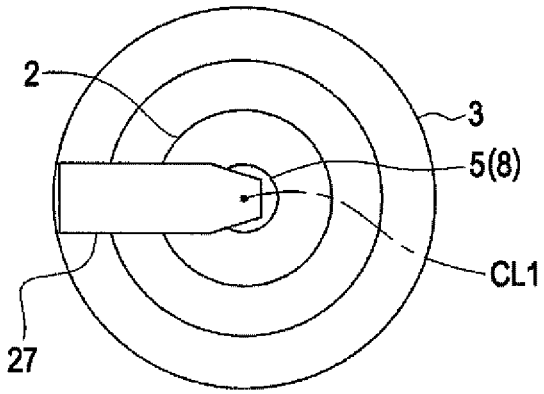
FIG. 15 is an enlarged partial bottom view illustrating the configuration of a tip end portion of a spark plug according to another embodiment.

(a) In the second embodiment, the ground electrode 27 is configured to have the same width. However, as illustrated in FIG. 15, it may be configured such that the cross-sectional area of the proximal end portion of the ground electrode 27 is ensured to some extent while the width of the tip end portion of the ground electrode 27 (the portion facing the tip end portion of the electrode 8) is made narrow. In this case, the total volume can be further reduced without reducing the joint strength of the ground electrode 27, and larger plasma can be generated.

Figure 16A:
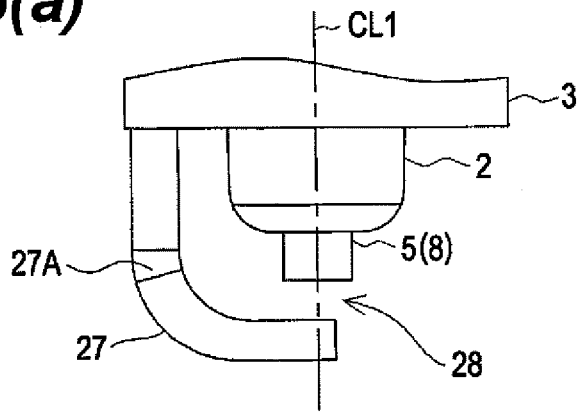
FIG. 16(*a*) is an enlarged partial front view of a tip end portion of a spark plug according to another embodiment, and FIG. 16(*b*) is an enlarged partial bottom view of the tip end portion of the spark plug according to the another embodiment.
Figure 16B:
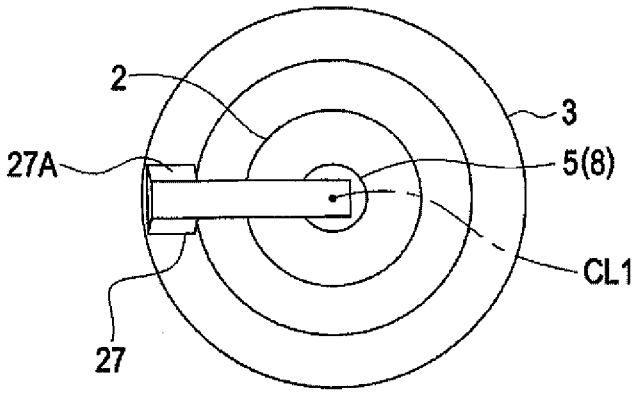

Moreover, as illustrated in FIGS. 16(*a*) and 16(*b*), in addition to the tip end portion of the ground electrode 27, the width of the gap corresponding portion 27A may be configured to be narrow. In this case, the flow of gas to the spark discharge gap 28 is expedited, and a further improvement in ignitability can be promoted.

Figure 17A:
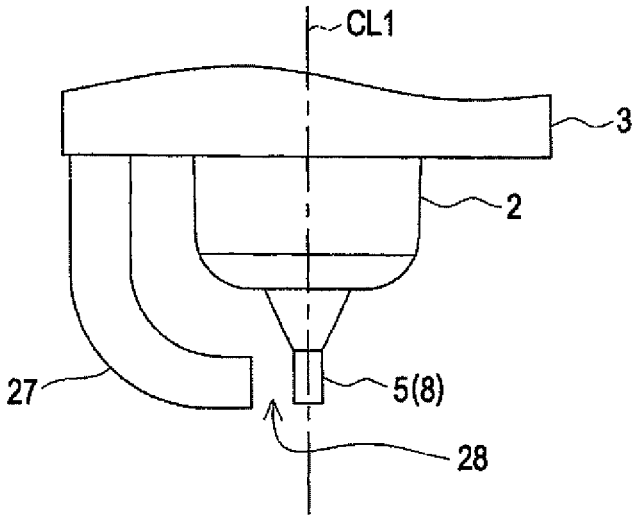
FIG. 17(*a*) is an enlarged partial front view of a tip end portion of a spark plug according to another embodiment, and FIG. 17(*b*) is an enlarged partial bottom view of the tip end portion of the spark plug according to the another embodiment.
Figure 17B:
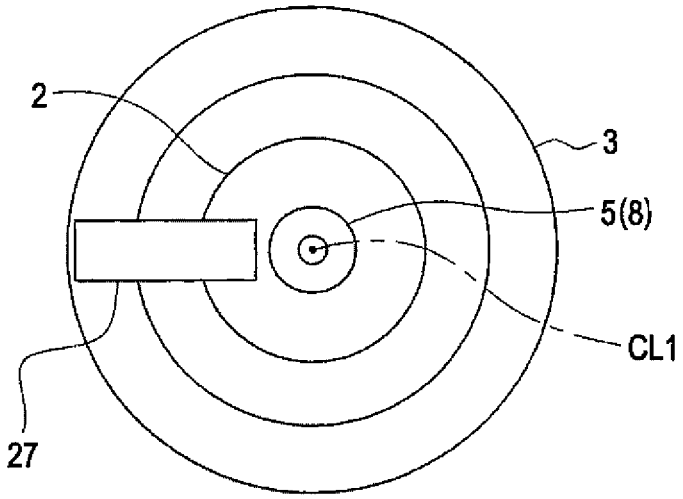

(b) In the spark plug 1 in the above embodiments, the front end surface of the electrode 8 is configured to face the ground electrode 27. However, the configuration of the spark plug 1 is not limited to this. Therefore, for example, as illustrated in FIGS. 17(*a*) and 17(*b*), it may be configured such that the outer periphery of the tip end portion of the electrode 8 (the center electrode 5) faces the tip end surface of the ground electrode 27. In this case, plasma is more likely to grow toward the tip end side in the axis CL1 direction (the center side of the combustion chamber). Accordingly, ignitability can be further improved.

Figure 18A:
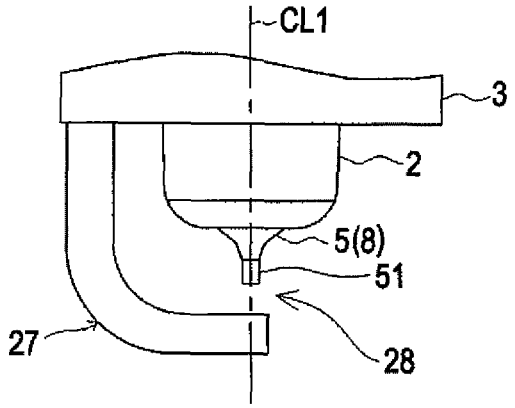
FIGS. 18(*a*) to 18(*c*) are enlarged partial front views illustrating the configuration of a tip end portion of a spark plug according to another embodiment.
Figure 18B:
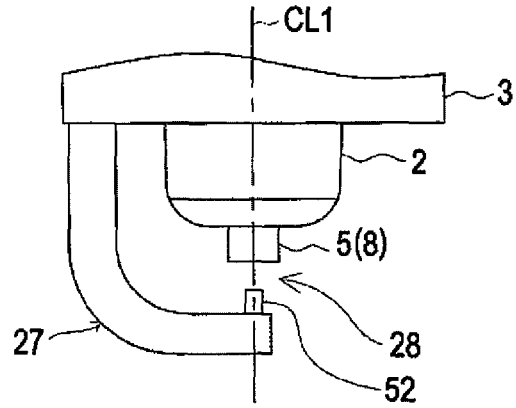
Figure 18C:
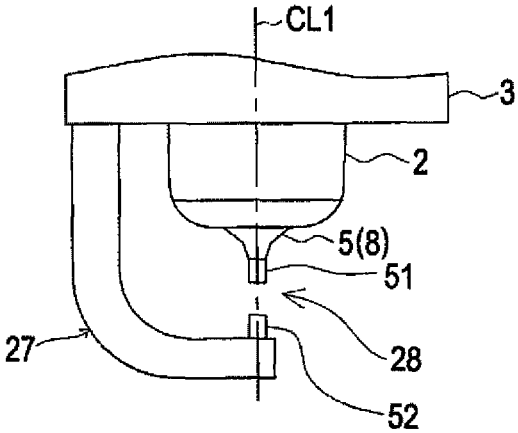

(c) In the embodiments, the spark discharge gap 28 is formed between the center electrode 5 and the ground electrode 27. However, as illustrated in FIGS. 18(*a*) to 18(*c*), it may be configured such that precious metal tips 51 and 52 including a precious metal alloy (e.g., a platinum alloy or an iridium alloy) are provided to at least one of the electrodes 5 and 27, and the spark discharge gap 28 is formed between the precious metal tip 51 (52) provided to one electrode 5 (27) of them and the other electrode 27 (5), or between both of the precious metal tips 51 and 52 provided to both of the electrodes 5 and 27. In this case, it is possible to further reduce the total volume, and promote a further improvement in ignitability.

Figure 19A:
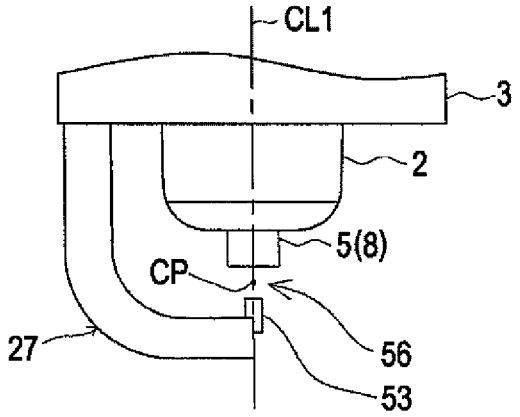
FIGS. 19(*a*) to 19(*c*) are enlarged partial front views illustrating the configuration of a tip end portion of a spark plug according to another embodiment.
Figure 19B:
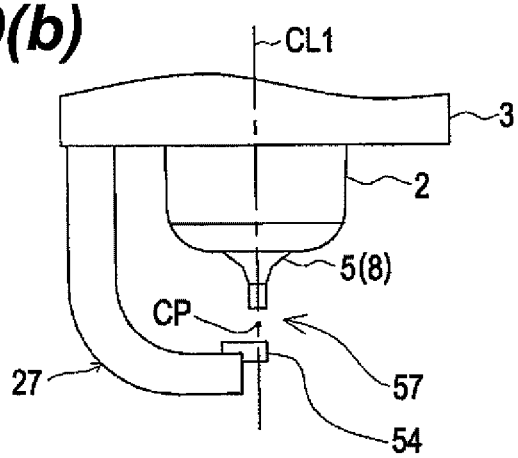
Figure 19C:
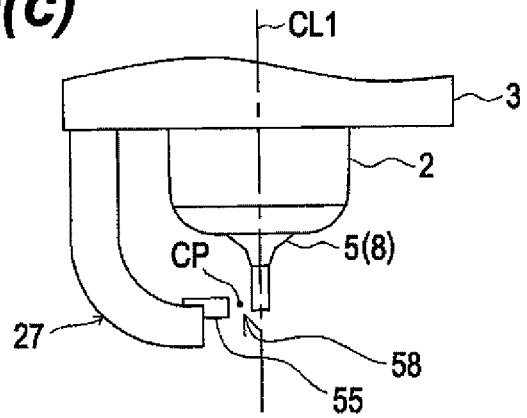

Moreover, when a precious metal tip is provided to the ground electrode 27, as illustrated in FIGS. 19(*a*) to 19(*c*), precious metal tips 53, 54 and 55 may be joined so as to protrude from the tip end surface of the ground electrode 27. In this case, the ground electrode 27 is farther away from the center CP of the spark discharge gaps 56, 57 and 58, and it is possible to still further reduce the total volume. Moreover, plasma is more likely to spread toward the center side of the combustion chamber. As a result, plasma to be generated can be made very large, and ignitability can be improved more effectively.

Figure 20A:
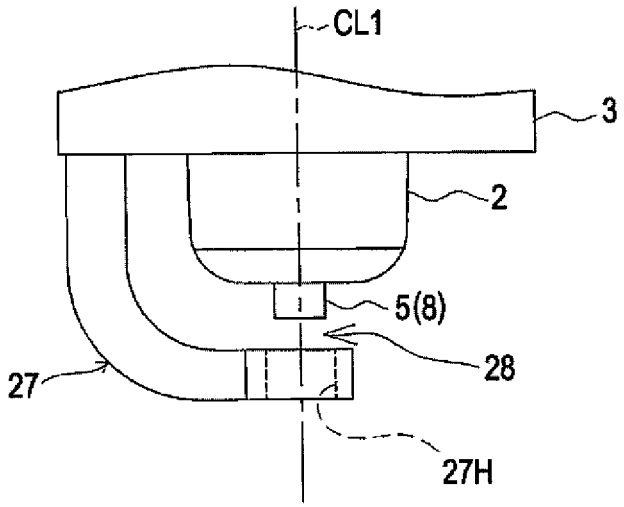
FIG. 20(*a*) is an enlarged partial front view of a tip end portion of a spark plug according to another embodiment, and FIG. 20(*b*) is an enlarged partial bottom view of the tip end portion of the spark plug according to the another embodiment.
Figure 20B:
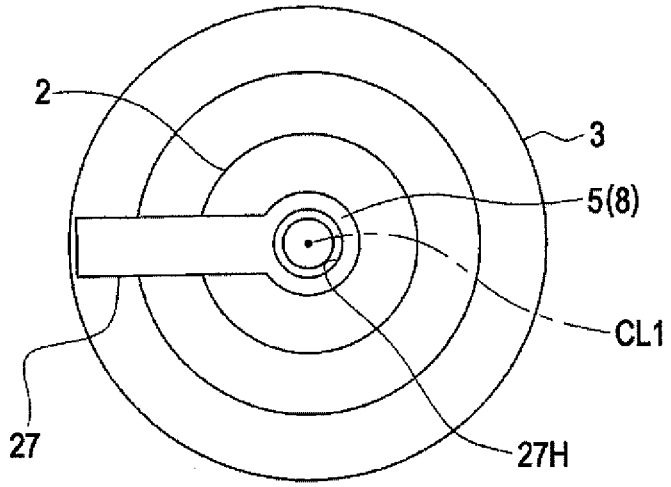
Figure 21A:
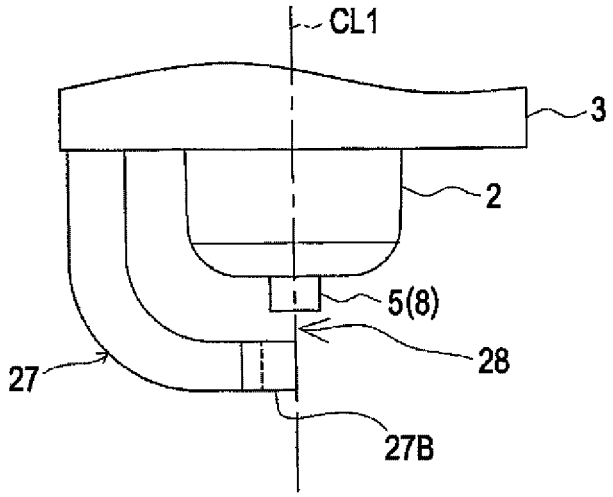
FIG. 21(*a*) is an enlarged partial front view of a tip end portion of a spark plug according to another embodiment, and FIG. 21(*b*) is an enlarged partial bottom view of the tip end portion of the spark plug according to the another embodiment.
Figure 21B:
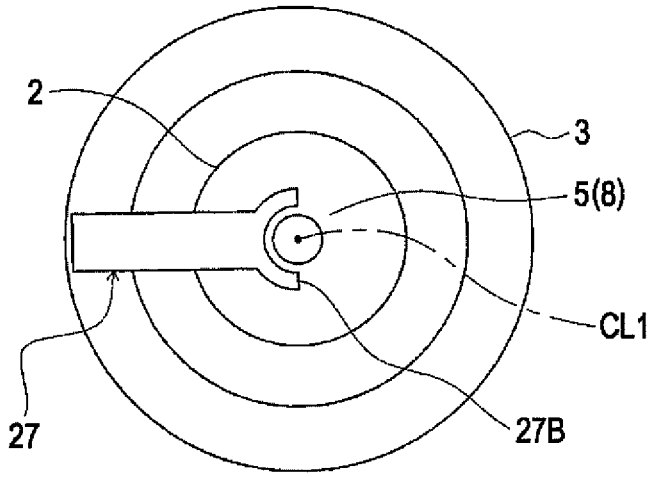
Figure 22:
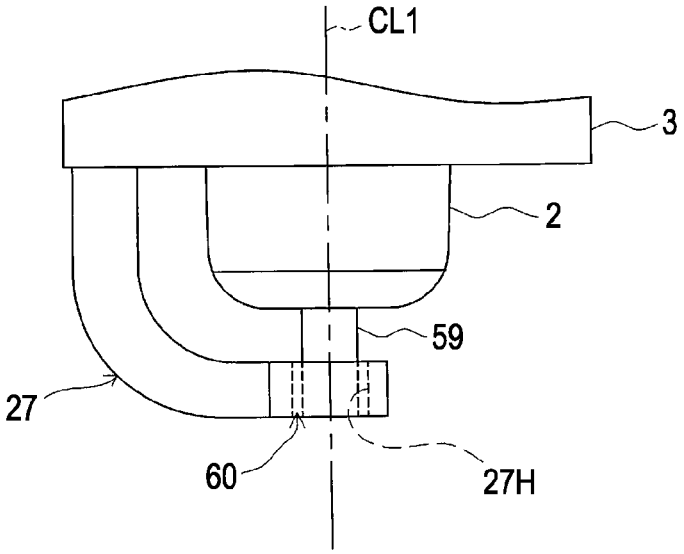
FIG. 22 is an enlarged partial front view of a tip end portion of a spark plug according to another embodiment.
Figure 23A:
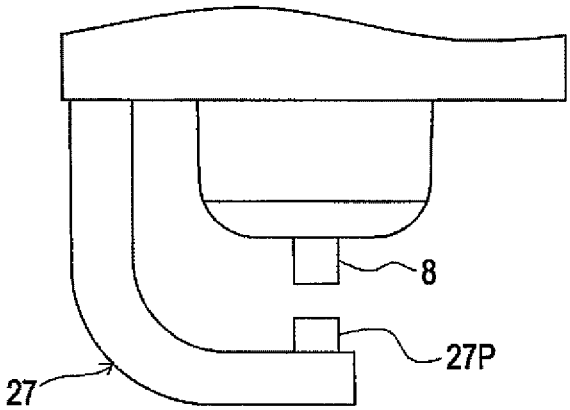
FIG. 23(*a*) is an enlarged partial front view illustrating the configuration of a tip end portion of a sample A, and FIG. 23(*b*) is an enlarged partial front view illustrating the configuration of a tip end portion of a sample B.
Figure 23B:
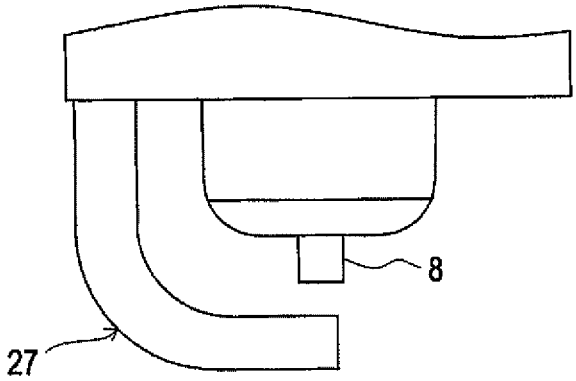

(d) In the above embodiments, when viewed from the tip end side in the axis CL1 direction, a part of the tip end surface of the electrode 8 is covered with the ground electrode 27. However, it may be configured such that a hole portion 27H is provided to the tip end of the ground electrode 27 as illustrated in FIGS. 20(*a*) and 20(*b*), or a Y-shaped branch portion 27B is provided to the tip end portion of the ground electrode 27 as illustrated in FIGS. 21(*a*) and 21(*b*) to enable the visual identification of the entire tip end surface of the electrode 8 without covering the tip end surface of the electrode 8 with the ground electrode 27, when viewed from the tip end side in the axis CL1 direction. In this case, plasma spreads more largely toward the center side of the combustion chamber, and a further improvement in ignitability can be promoted. As illustrated in FIGS. 22(*a*) and 22(*b*), it may be configured such that a tip end portion of an electrode 59 is inserted into the hole portion 27H of the ground electrode 27, and a spark discharge gap 60 is formed between the inner peripheral surface of the hole portion 27H and the outer peripheral surface of the electrode 59.

(e) In the above embodiments, the tool engagement portion 19 has a hexagonal cross section. However, the shape of the tool engagement portion 19 is not limited to this. For example, the tool engagement portion 19 may have a Bi-HEX (modified dodecagonal) shape [ISO22977:2005(E)].

(f) In the above embodiments, power from the discharge power supply 32 and the AC power supply 33 is supplied to the spark plugs 1 via the distributor. However, the discharge power supply 32 and the AC power supply 33 may be provided for each spark plug 1.

The invention claimed is:

1. An ignition system comprising:

a spark plug;

a discharge power supply for applying voltage to the spark plug to generate a spark discharge; and an AC power supply for supplying AC power to a spark generated by the spark discharge, wherein an oscillation frequency of the AC power is set to 100 MHz or less, wherein the spark plug includes:

an insulator having an axial hole extending in an axis direction thereof, an electrode disposed in the axial hole and having a tip end located frontward of a tip end of the insulator in the axis direction, a metal shell arranged on a periphery of the insulator, and a ground electrode fixed to an end portion of the metal shell and forming a gap between the tip end portion of the electrode and the ground electrode, voltage from the discharge power supply and AC power from the AC power supply are supplied to the gap through the electrode, and the AC power from the AC power supply is applied to a spark generated by the voltage from the discharge power supply in the gap.

2. The ignition system according to claim 1, wherein, with a wavelength of the AC power set to $\lambda$ (m), a protruding length of the tip end of the electrode from the tip end of the metal shell along the axis is set to $\lambda/8$ (m) or less.

3. The ignition system according to claim 1 or 2, wherein an average value of the AC power to be applied to a spark at one spark discharge is set to 50 W or more and 500 W or less.

4. The ignition system according to claim 1 or 2, wherein a size of the gap is set to 1.3 mm or less.

5. The ignition system according to claim 1 or 2, wherein the insulator does not exist in an area with a radius of 1 mm from the center of the gap.

6. The ignition system according to claim 1 or 2, wherein the oscillation frequency of the AC power is set to 5 MHz or more and 100 MHz or less.

7. The ignition system according to claim 1 or 2, wherein electrostatic capacity of a portion of the spark plug, the portion being located frontward of the tip end of the metal shell in the axis direction, is set equal to or less than one hundredth of electrostatic capacity of the whole spark plug.

8. The ignition system according to claim 1 or 2, wherein total volume of portions of the electrode, the ground electrode, and the insulator, the portions being located in an area with a radius of 2.5 mm from the center of the gap, is set to 20 $mm^3$ or less.

9. The ignition system according to claim 8, wherein on a projection plane upon projecting the ground electrode and the center of the gap on a surface orthogonal to a line segment linking the electrode and the ground electrode and forming the shortest distance of the gap with respect to a direction in which the line segment extends, an area of a projection region of the ground electrode, which is located in an area with a radius of 2 mm from a projection point at the center of the gap, is set to 7.6 $mm^2$ or less.

10. The ignition system according to claim 8, wherein the ground electrode includes a gap corresponding portion corresponding to the gap in the axis direction, and a minimum width of the gap corresponding portion is set to 3.0 mm or less.

11. The ignition system according to claim 8, wherein, when viewed from the tip end side in the axis direction, at least part of a tip end surface of the electrode is configured to be visually identifiable.

12. The ignition system according to claim 8, wherein at least the tip end portion of the electrode forms a circular column, and an outside diameter of the tip end portion of the electrode is set to 3.0 mm or less.

13. The ignition system according to claim 8, wherein a protruding length of the ground electrode from the end of the metal shell along the axis is set to 10 mm or less.

14. A spark plug used for the ignition system according to claim 1.

* * * * *